US005704768A

United States Patent [19]

Kobayashi et al.

[11] Patent Number: 5,704,768

[45] Date of Patent: Jan. 6, 1998

[54] MOTOR PUMP FAMILY OF CENTRIFUGAL PUMPS

[75] Inventors: Makoto Kobayashi; Masakazu Yamamoto; Yoshio Miyake, all of Fujisawa, Japan

[73] Assignee: Ebara Corporation, Tokyo, Japan

[21] Appl. No.: 713,958

[22] Filed: Sep. 12, 1996

Related U.S. Application Data

[60] Continuation of Ser. No. 450,614, May 25, 1995, abandoned, which is a division of Ser. No. 322,340, Oct. 13, 1994, abandoned.

[30] Foreign Application Priority Data

Oct. 13, 1993 [JP] Japan ..... 5-280108
Oct. 13, 1993 [JP] Japan ..... 5-280109

[51] Int. Cl.[6] ..... F04B 3/00

[52] U.S. Cl. ..... 417/62; 417/247; 417/248; 415/61

[58] Field of Search ..... 417/62, 247, 248; 415/1, 61

[56] References Cited

U.S. PATENT DOCUMENTS

| | | | |
|---|---|---|---|
| 2,069,161 | 1/1937 | Griswold | 417/247 |
| 2,207,220 | 7/1940 | Hollander | 415/61 |
| 2,223,592 | 10/1940 | Barton et al. | 415/61 |
| 2,468,008 | 4/1949 | Yocum | 415/61 |
| 2,842,306 | 7/1958 | Buchi | 417/247 |
| 3,198,121 | 8/1965 | Schaub | 417/4 |
| 3,658,440 | 4/1972 | Jackson | 417/62 |
| 3,699,774 | 10/1972 | Davis et al. | 417/426 |
| 3,981,628 | 9/1976 | Carter | 417/424 |
| 4,190,395 | 2/1980 | Ball | 415/61 |
| 4,274,803 | 6/1981 | Spengler et al. | 415/70 |

FOREIGN PATENT DOCUMENTS 1063 033 10/1953 Germany .

OTHER PUBLICATIONS

International Standard ISO 2858, End-suction centrifugal pumps (rating 16 bar) — Designation, nominal duty point and dimensions, Feb. 15, 1975.

Worthington D-1000 new standard end-suction pumps 415/912, 1973, pp. 10-14.

*Primary Examiner*—Timothy Thorpe
*Assistant Examiner*—Ted Kim
*Attorney, Agent, or Firm*—Oblon, Spivak, McClelland, Maier & Neustadt, P.C.

[57] ABSTRACT

A motor pump group has a plurality of centrifugal pumps of the same nominal port diameter including a plurality of impellers having stepwise greater outside diameters for stepwise higher pump heads, and a plurality of respective motors for actuating the pumps. The pump heads are classified into a low head section and a high head section. The low head section is handled by a single-stage impeller, and the high head section is handled by multi-stage impellers. The centrifugal pumps have respective pressed-sheet pump casings. The outside diameters of the impellers are not required to be increased in the high head section, and the outside diameters of the pump casings fall in a relatively small range.

1 Claim, 17 Drawing Sheets

LOW HEAD SECTION

LOW HEAD SECTION

HIGH HEAD SECTION

LOW HEAD SECTION

HIGH HEAD SECTION

1ST GROUP OF CENTRIFUGAL PUMPS
OF NOMINAL PORT DIAMETER ($\Phi 1$)

LOW

2ND GROUP OF CENTRIFUGAL PUMPS
OF NOMINAL PORT DIAMETER ($\Phi 2$)
WHICH IS ONE STEP GREATER

MEDIUM

LOW

HIGH

MEDIUM

HIGH

1ST GROUP OF CENTRIFUGAL PUMPS OF NOMINAL PORT DIAMETER ($\Phi_1$)

2ND GROUP OF CENTRIFUGAL PUMPS OF NOMINAL PORT DIAMETER ($\Phi_2$) WHICH IS ONE STEP GREATER

LOW HEAD SECTION

LOW

MEDIUM

LOW HEAD SECTION

LOW

HIGH

MEDIUM

HIGH HEAD SECTION

LOW

HIGH

1ST GROUP OF CENTRIFUGAL PUMPS OF NOMINAL PORT DIAMETER ($\Phi_1$)

2ND GROUP OF CENTRIFUGAL PUMPS OF NOMINAL PORT DIAMETER ($\Phi_2$) WHICH IS ONE STEP GREATER

1ST GROUP OF CENTRIFUGAL PUMPS OF NOMINAL PORT DIAMETER ($\Phi_1$)

2ND GROUP OF CENTRIFUGAL PUMPS OF NOMINAL PORT DIAMETER ($\Phi_2$) WHICH IS ONE STEP GREATER

LOW HEAD SECTION

LOW

MEDIUM

LOW HEAD SECTION

LOW

HIGH

MEDIUM

HIGH HEAD SECTION

LOW

HIGH

1ST GROUP OF CENTRIFUGAL PUMPS OF NOMINAL PORT DIAMETER ($\Phi_1$)

HIGH HEAD SECTION

MEDIUM

HIGH

2ND GROUP OF CENTRIFUGAL PUMPS OF NOMINAL PORT DIAMETER ($\Phi_2$) WHICH IS ONE STEP GREATER

HIGH HEAD SECTION

LOW

MEDIUM

HIGH

MOTOR PUMP FAMILY OF CENTRIFUGAL PUMPS

This application is a Continuation of application Ser. No. 08/450,614, filed on May 25, 1995, now abandoned, which is a divisional of Ser. No. 08/322,340 filed on Oct. 13, 1994, now abandoned.

BACKGROUND OF THE INVENTION

1. Field of the Invention

The present invention relates to a motor pump group and a method of manufacturing such a motor pump group. More particularly, it relates to a motor pump group comprising a plurality of pressed-sheet pumps of the same nominal port diameter having a series of impellers of stepwise greater outside diameters for stepwise higher pump heads, and a motor for actuating the pumps, and a method of manufacturing such a motor pump group.

2. Description of the Prior Art

There have heretofore been available international standards (ISO) defining major dimensions and nominal particulars of single-suction centrifugal pumps. Table 1, below, shows some of the international standards relative to the single-suction centrifugal pumps.

TABLE 1

ISO standards (at 50 Hz)

| Nominal dimensions | | | Nominal particulars | | | |
|---|---|---|---|---|---|---|
| | | | n 1450 min$^{-1}$ | | n 2900 min$^{-1}$ | |
| Suction (port) (mm) | Discharge port (mm) | Impeller (nominal) (mm) | Q (m$^3$/h) | H (m) | Q (m$^3$/h) | H (m) |
| 50 | 32 | 125 | 6.3 | 5 | 12.5 | 20 |
| 50 | 32 | 160 | | 8 | | 32 |
| 50 | 32 | 200 | | 12.5 | | 50 |
| 50 | 32 | 250 | | 20 | | 80 |
| 65 | 50 (40) | 125 | 12.5 | 5 | 25 | 20 |
| 65 | 50 (40) | 160 | | 8 | | 32 |
| 65 | 40 | 200 | | 12.5 | | 50 |
| 65 | 40 | 250 | | 20 | | 80 |
| 65 | 40 | 315 | | 32 | | 125 |
| 80 | 65 (50) | 125 | 25 | 5 | 50 | 20 |
| 80 | 65 (50) | 160 | | 8 | | 32 |
| 80 | 50 | 200 | | 12.5 | | 50 |
| 80 | 50 | 250 | | 20 | | 80 |
| 80 | 50 | 315 | | 32 | | 125 |
| 100 | 80 (65) | 125 | 50 | 5 | 100 | 20 |
| 100 | 80 (65) | 160 | | 8 | | 32 |
| 100 | 65 | 200 | | 12.5 | | 50 |
| 100 | 65 | 250 | | 20 | | 80 |
| 100 | 65 | 315 | | 32 | | 125 |

As can be seen from Table 1, each of the nominal ratio of the nominal dimensions of the suction port and the nominal ratio of the outside diameters of the impeller is set to 1.25 or a similar value. The nominal ratio of pump heads is set to $(1.25)^2=1.6$ or a similar value, and the nominal ratio of flow rates is set to 2.

If an impeller is to be manufactured according to the international standards (ISO), then the outside diameter of the impeller is too large in a region of high pump heads. More specifically, in a region of the highest pump head, the outside diameter of an impeller is given as 250 mm for a suction port diameter of 50 mm, and as 315 mm for a suction port diameter of 100 mm. In a region of high pump heads, therefore, the outside diameter of a pump casing is necessarily large. If the outside diameter of a pressed-sheet pump casing is too large, then it is difficult to make the pump casing sufficiently rigid.

According to the conventional international standards, since the nominal ratio of pump heads is set to 1.6 or a similar value, it is impossible to select pump heads in small increments.

According to the ISO standards, the nominal ratio of pump diameters is 1.25 whereas the nominal ratio of flow rates is set to 2. Therefore, as the diameter increases from the diameter-to-area nominal ratio of $1.25^2=1.6$, the speed of flow in the pipe increases, resulting in an increased pressure loss.

One more serious problem is that difficulty arises with respect to sharing of motors according to conventional international standards. Specifically, it can be seen from Table 2 which shows the relationship between particulars Q (flow rate), H (pump head), and P (output), that eleven types of motors are required for twelve particulars (providing the pump efficiency is constant), and a large number of motor types are required to meet a given range of particulars according to the ISO standards.

TABLE 2

Relationship between particulars and outputs according to the international standards (at 50 Hz) (head nominal ratio: 1.6, flow rate nominal ratio: 2)

| | | | |
|---|---|---|---|
| 4 H | 4 P | 8 P | 16 P |
| 2.5 H | 2.5 P | 5 P | 10 P |
| 1.6 H | 1.6 P | 3.2 P | 6.3 P |
| H | Output P | 2 P | 4 P |
| Head/flow rate | Q | 2 Q | 4 Q |

On the other hand, there has been known a feed water pump system in which the number of pumps to be in operation is controlled to feed the required water consumption while keeping delivery pressure or discharge pressure constant. This feed water pump system is normally provided with four pumps which have the same performance.

In case of using four pumps having the same performance, assuming that the flow rate of a single pump equals to $Q_1=1.0$, four flow rates are obtained as shown in Table 3.

TABLE 3

| The number of pumps to be in operation | Flow rate |
|---|---|
| 1 | $Q_1 \times 1 = 1.0$ |
| 2 | $Q_2 \times 2 = 2.0$ |
| 3 | $Q_3 \times 3 = 3.0$ |
| 4 | $Q_4 \times 4 = 4.0$ |

In this case, four flow rates are obtained. In other words, in case of using four pumps which have the same performance, only a small number of flow rates are obtained.

Therefore, there has been a demand that a large number of flow rates are obtained and the pumps can be efficiently operated in accordance with the required water consumption.

SUMMARY OF THE INVENTION

It is therefore an object of the present invention to provide a motor pump group composed of a plurality or family of pressed-sheet pumps of the same nominal port diameter which are not required to have increased impeller outside diameters in a region of high pump heads and allow a pump casing to have an outside diameter in a relatively small range, and a method of manufacturing such a motor pump group.

Another object of the present invention is to provide a motor pump group which maintains the same flow speed in pipes and allows a small number of motors to deal with many particulars at any diameter.

Another object of the present invention is to provide a feed water pump system which can obtain a large number of flow rates and operate a plurality of pumps efficiently in accordance with the required water consumption.

According to one aspect of the present invention, there is provided a motor pump group comprising: a single-stage pump group including a plurality of centrifugal pumps having a single-stage impeller whose outside diameter is stepwise greater as pump head is stepwise higher; a multi-stage pump group including a plurality of centrifugal pumps having multi-stage impellers whose outside diameter is stepwise greater as pump head is stepwise higher; a plurality of respective motors for actuating said pumps; and wherein said pump head is classified into a low head section and a high head section, and said low head section is handled by said single-stage pump group and said high head section is handled by said multi-stage pump group.

According to another aspect of the present invention, there is also provided a method of manufacturing a pump of a motor pump group comprising a single-stage pump group including a plurality of centrifugal pumps having a single-stage impeller whose outside diameter is stepwise greater as pump head is stepwise higher, a multi-stage pump group including a plurality of centrifugal pumps having multi-stage impellers whose outside diameter is stepwise greater as pump head is stepwise higher, and a plurality of respective motors for actuating said pumps, the method comprising the steps of: classifying said pump heads into a low head section and a high head section; designing the pumps for said low head section with a single impeller; designing the pumps for said high head section with multiple impeller each having an outside diameter which is the same as the outside diameter of said impeller; and producing any one of the pumps which have been designed.

According to still another aspect of the present invention, there is provided a motor pump group comprising: a plurality of centrifugal pumps; and a plurality of respective motors for actuating said pumps; wherein the nominal ratio K of flow rates of said pumps at substantially the same diameter is about 1.6, and the nominal ratio of the pump heads thereof is about $K^{1/n}$ (where n is a positive integer).

Since a pump head region is divided into a low head section and a high head section, and the low head section is handled by a single-stage pump group including a plurality of centrifugal pumps each having a single-stage impeller, and the high head section is handled by a multi-stage pump group including a plurality of centrifugal pumps each having multi-stage impellers, it is not necessary to increase the outside diameters of the impellers in the high head section at the same nominal port diameter, and also to increase the outside diameter of the pump casing. Consequently, if a series of pumps are made available at the same nominal port diameter, then the outside diameters of the pump casings can be placed in a relatively small range, and the series of pumps is suitable for pressed-sheet pump casings with reduced rigidity.

The low head section is handled by a plurality of centrifugal pumps each having a single-stage impeller to produce a plurality of pump heads, and the high head section is handled by a plurality of centrifugal pumps each having multi-stage impellers to produce a plurality of pump heads. Thus, some shared components such as pump casings, impellers, and their related parts may be used for low pump heads of the low and high head sections, medium pump heads of the low and high head sections, and high pump heads of the low and high head sections. Consequently, the number of components of the series of pumps may be reduced.

The ratios between the stepwise greater outside diameters of said impellers are substantially equal to each other. Specifically, these ratios are $R=2^{1/6}$. Since the nominal ratio of impeller outside diameters is set to 1.12 or a similar value, the nominal ratio of pump heads is $(1.12)^2=1.25$ or a similar value. Therefore, pump heads can be selected in smaller increments than according to the conventional international standards.

In a group of motor pumps having adjacent nominal port diameters, the outside diameter of an impeller of a pump having a greater nominal port diameter is equal to the outside diameter of an impeller of a pump having a smaller nominal port diameter for a pump head that is one step higher. For example, if a motor pump group has a port diameter ($\phi_1$) and an adjacent larger port diameter ($\phi_2$), and three pump heads (low, medium, and high), then the outside diameter of an impeller of the low head at the port diameter ($\phi_2$) is equal to the outside diameter of the impeller of the medium head at the port diameter ($\phi_1$), and the outside diameter of the impeller of the medium head at the port diameter ($\phi_2$) is equal to the outside diameter of the impeller of the high head at the port diameter ($\phi_1$). Similarly, the other heads are successively shifted one rank. Inasmuch as the outside diameter of an impeller at the smaller port diameter ($\phi_1$) is equal to the outside diameter of an impeller at the larger port diameter ($\phi_2$) for pump heads which are one step different from each other, impellers, pump casings, and their related parts can be shared, and the number of components of the series of pumps can be reduced.

For the same pump head, the nominal ratio of motor output powers (kw) with respect to port diameter changes is about 1.6 or a similar value. As the nominal ratio of 1.6 corresponds to $(1.25)^2$, it is the same as increments of an output nominal ratio $(1.25)^n$ at the port diameter ($\phi_1$), resulting in the same series of motor outputs. Specifically, a motor output at the port diameter ($\phi_1$) and a motor output at the adjacent larger port diameter ($\phi_2$) agree with each other at a pump head at the port diameter ($\phi_2$) which is two steps lower than a pump head at the port diameter ($\phi_1$). Where the motor outputs agree with each other, the motors can be shared.

Since the nominal ratio of pump port diameters is set to about 1.25 and the nominal ratio of flow rates is set to about 1.6, the port-diameter-to-area nominal ratio ($1.25^2=1.6$) is equal to the nominal ratio of flow rates, allowing the same flow speed in the pipes at any of the diameters, and preventing the pressure loss from being increased even if the port diameter is increased.

As can be seen from Table 4 (which shows the relationship between particulars and outputs with K=1.6, n=1) given below, 16 particulars can be handled by 7 types of motors. A comparison between Tables 2 and 4 clearly indicates that the number of types of motors required to satisfy the same range of particulars is much smaller than the number of types of motors required by the conventional international standards.

TABLE 4

| Relationship between particulars and outputs with K = 1, n = 1 (at 50 Hz) (head nominal ratio: 1.6, flow rate nominal ratio: 1.6) | | | | |
|---|---|---|---|---|
| 4 H | 4 P | 6.3 P | 10 P | 16 P |
| 2.5 H | 2.5 P | 4 P | 6.3 P | 10 P |
| 1.6 H | 1.6 P | 2.5 P | 4 P | 6.3 P |
| H | Output P | 1.6 P | 2.5 P | 4 P |
| Head/flow rate | Q | 1.6 Q | 2.5 Q | 4 Q |

According to still another aspect of the present invention, there is provided a feed water pump system: a feed water pump system in which the number of pumps to be in operation is controlled to feed the required water consumption while keeping discharge pressure constant, the system comprising: a first pump set comprising two pumps having the same performance; and a second pump set comprising two pumps having the same performance; wherein said pumps of said first pump set have substantially the same shut-off head as said pumps of said second pump set and a different flow rate from said pumps of said second pump set.

In the case where the nominal ratio of flow rate $Q_1$ of the first pump set to flow rate $Q_2$ of the second pump set is 2, six flow rates are obtained as shown in Table 5.

TABLE 5

| The number of pumps to be in operation | Flow rate |
|---|---|
| 1 | $Q_1 = 1.0$ |
| 1 | $Q_2 = 2.0$ |
| 2 | $Q_1 \times 2 = 1.0 \times 2 = 2.0$ |
| 2 | $Q_1 + Q_2 = 1.0 + 2.0 = 3.0$ |
| 2 | $Q_2 \times 2 = 2.0 \times 2 = 4.0$ |
| 3 | $(Q_1 \times 2) + Q_2 = 4.0$ |
| 3 | $Q_1 + (Q_2 \times 2) = 5.0$ |
| 4 | $(Q_1 \times 2) + (Q_2 \times 2) = 6.0$ |

Table 6 shows the case where the nominal ratio of flow rate $Q_1$ of the first pump set to flow rate $Q_2$ of the second pump set is 1.6.

TABLE 6

| The number of pumps to be in operation | Flow rate |
|---|---|
| 1 | $Q_1 = 1.0$ |
| 1 | $Q_2 = 1.6$ |
| 2 | $Q_1 \times 2 = 1.0 \times 2 = 2.0$ |
| 2 | $Q_1 + Q_1 = 1.0 + 1.6 = 2.6$ |
| 2 | $Q_2 \times 2 = 1.6 \times 2 = 3.2$ |
| 3 | $(Q_1 \times 2) + Q_2 = 3.6$ |
| 3 | $Q_1 + (Q_2 \times 2) = 4.2$ |
| 4 | $(Q_1 \times 2) + (Q_2 \times 2) = 5.2$ |

In this case, eight flow rate patterns are obtained, therefore it is possible to operate the pumps efficiently in accordance with the required water consumption. Further, the difference between the upper and lower flow rates is substantially equivalent, thus the flow rate can be finely controlled.

As described above, in case of the nominal ratios 2.0 and 1.6, the flow rate patterns increase compared with the conventional feed water pump system comprising four pumps having the same performance.

Further, according to the present invention, when switching operation pattern, transit operation patterns are provided to avoid instantaneous pressure decrease.

Table 7 shows eight operation patterns.

TABLE 7

| Operation pattern | The kind of pumps & the number of pumps | Flow rate |
|---|---|---|
| A | 1.0 × 1 pump | 1.0 |
| B | 1.6 × 1 pump | 1.6 |
| C | 1.0 × 2 pumps | 2.0 |
| D | 1.0 × 1 pump + 1.6 × 1 pump | 2.6 |
| E | 1.6 × 2 pumps | 3.2 |
| F | 1.0 × 2 pumps + 1.6 × 1 pump | 3.6 |
| G | 1.0 × 1 pump + 1.6 × 2 pumps | 4.2 |
| H | 1.0 × 2 pumps + 1.6 × 2 pumps | 5.2 |

Eight operation pattern are switched using transit operation patterns in the following manner:

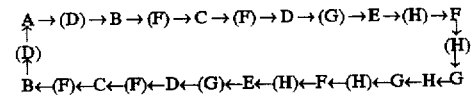

In the above, transit operation patterns are shown using ( ).

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1A:
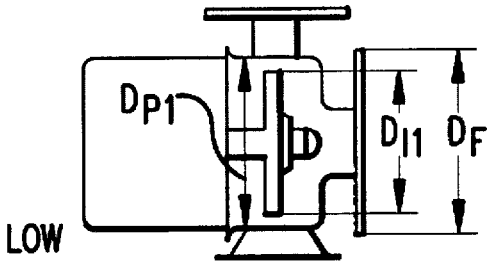
FIG. 1 is a view of a motor pump group according to an embodiment of the present invention which incorporates horizontal centrifugal pumps.
Figure 1B:
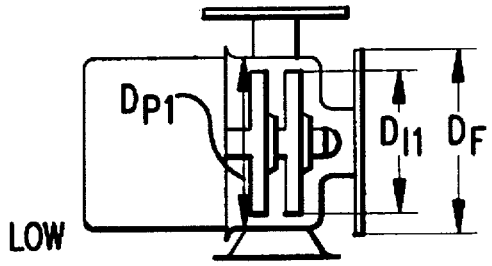
Figure 1C:
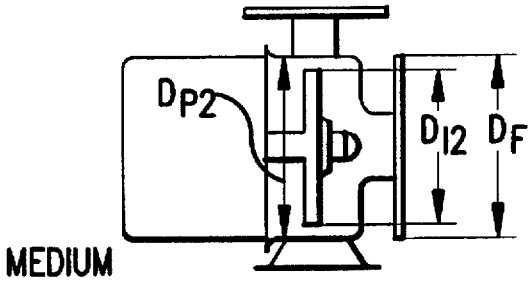
Figure 1D:
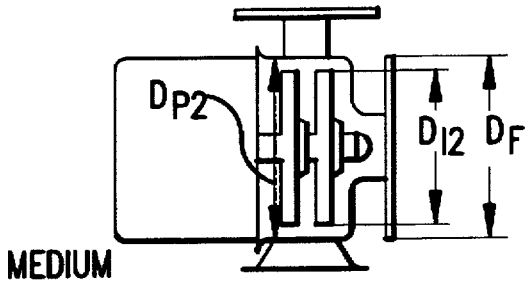
Figure 1E:
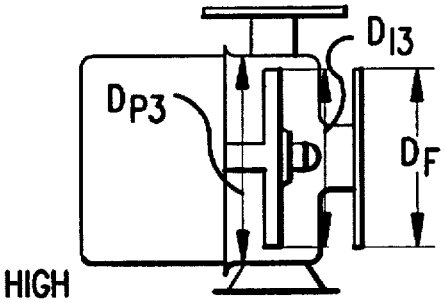
Figure 1F:
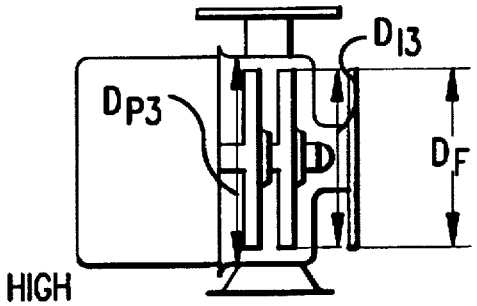

FIG. 1 shows a motor pump group according to an embodiment of the present invention which incorporates horizontal centrifugal pumps. The motor pump group comprises six centrifugal pumps having the same nominal port diameter. As shown in FIG. 1, the motor pump group has a pump head region divided into a low head section and a high head section. The low head section is handled by a single-stage pump group including three pumps having a single-stage impeller, and the high head section is handled by a multi-stage pump group including three pumps having two-stage impellers. Specifically, the low head section is handled by three single-stage impellers having respective outside diameters $D_{I1}$, $D_{I2}$, $D_{I3}$ that are stepwise greater in the order named to produce low, medium, and high pump heads. The high head section is handled by three sets of two-stage impellers having respective outside diameters $D_{I1}$, $D_{I2}$, $D_{I3}$ that are stepwise greater in the order named to produce low, medium, and high pump heads. The ratios between the stepwise greater outside diameters $D_{I1}$, $D_{I2}$, $D_{I3}$ are substantially equal to each other.

The single-stage impellers and the three sets of two-stage impellers are housed in respective pressed-sheet pump casings. The pressed-sheet pump casings for the low head section have respective stepwise larger outside diameters $D_{P1}$, $D_{P2}$, $D_{P3}$ for the low, medium, and high heads, respectively, and the pressed-sheet pump casings for the high head section also have respective stepwise larger outside diameters $D_{P1}$, $D_{P2}$, $D_{P3}$ for the low, medium, and high heads, respectively. Ratios between the stepwise greater outside diameters $D_{P1}$, $D_{P2}$, $D_{P3}$ are substantially equal to each other. Each of the nominal ratio of the pump casing outside diameters and the nominal ratio of the impeller outside diameters is set to 1.12 or a similar value.

In the motor pump group shown in FIG. 1, as described above, the low head section is handled by the three single-stage impellers, the high head section is handled respectively by the three sets of two-stage impellers, and the ratios between the impeller outside diameters are substantially equal to each other. These ratios R are given as $R=2^{(1/3)(1/2)}=2^{1/6}$. Therefore, the nominal ratio of the impeller outside diameters is 1.12 or a similar value, and hence the nominal ratio of pump heads is $(1.12)^2=1.25$ or a similar value. If the low head of the low head section is 100%, then the low, medium, and high heads of the low head section are 100%, 125%, and 160%, respectively, and the low, medium, and high heads of the high head section are 100×2=200%, 125×2=250%, and 160×2=320%. Consequently, the nominal ratio of the heads is smaller than the nominal ratio of 1.6 according to the conventional international standards, allowing pump heads to be selected in small increments.

As shown in FIG. 1, each of the pump casings has a suction flange outside diameter $D_F$ which is substantially the same as the pump casing outside diameter $D_{P2}$ for the medium head in each of the low and high head sections. Therefore, the suction flange outside diameter $D_F$ is slightly larger than the pump casing outside diameter $D_{P1}$ for the low head, and slightly smaller than the pump casing outside diameter $D_{P3}$ for the high head. The suction flange outside diameter $D_F$ is thus substantially equal or close to the pump casing outside diameter $D_{P1}$, $D_{P2}$, $D_{P3}$, so that the motor pump group is a space saver with no dead space included in the radial direction.

The nominal ratio between adjacent ones of stepwise greater nominal port diameters is set to 1.25 or a similar value as with the international standards. Specifically, the nominal port diameters of suction ports are set to absolute values of 50, 65, 80, 100, 125, . . . (mm). The nominal ratio of flow rates is set to the square of the nominal ratio of diameters, i.e., $(1.25)^2=1.6$ or a similar value. Therefore, the diameter-to-area nominal ratio and the flow rate nominal ratio are equal to each other, allowing the same flow speed in the pipes at any of the diameters.

The relationship between particulars and output with the flow rate nominal ratio K being 1.6 and n=2 is shown in Table 8 below:

TABLE 8

Relationship between particulars and output with K = 1.6 and n = 2 (at 50 Hz) (head nominal ratio: 1.25, flow rate nominal ratio: 1.6)

| | | | | |
|---|---|---|---|---|
| 4 H | 4 P | 6.3 P | 10 P | 16 P |
| 3.2 H | 3.2 P | 5 P | 8 P | 12.5 P |
| 2.5 H | 2.5 P | 4 P | 6.3 P | 10 P |
| 2 H | 2 P | 3.2 P | 5 P | 8 P |
| 1.6 H | 1.6 P | 2.5 P | 4 P | 6.3 P |
| 1.25 H | 1.25 P | 2 P | 3.2 P | 5 P |
| H | Output P | 1.6 P | 2.5 P | 4 P |
| Head/flow rate | Q | 1.6 Q | 2.5 Q | 4 Q |

Consequently, it is possible to increase the number of particulars to 16 simply by adding two motor types to those in Table 2 according to the conventional international standards.

Figure 2:
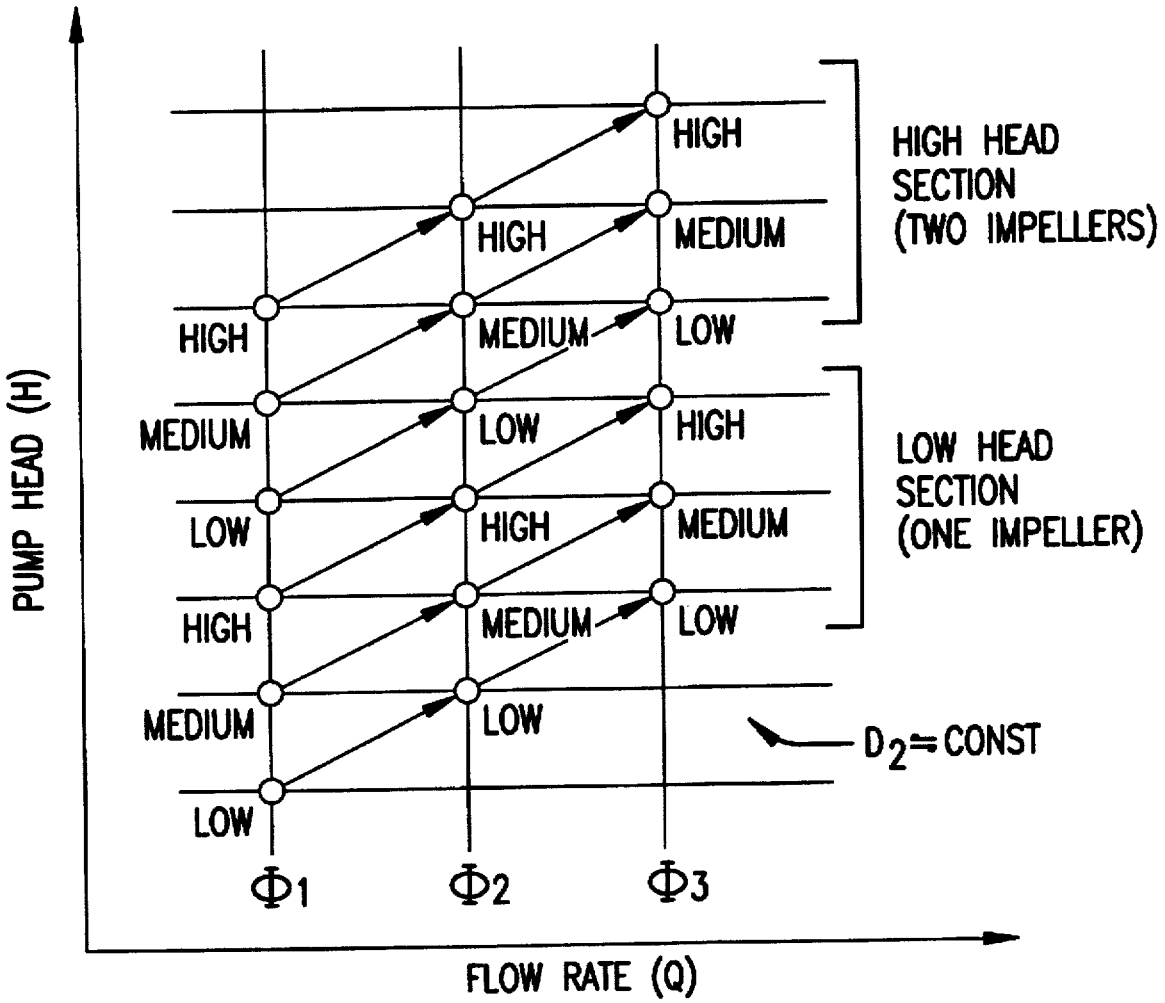
FIG. 2 is a diagram showing the relationship between flow rates (Q) and pump heads (H) with respect to changes in the diameter of the motor pump group shown in FIG. 1.
Figure 3A:
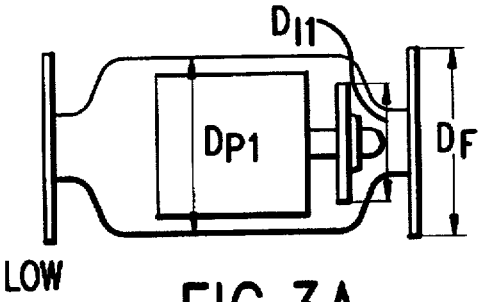
FIG. 3 is a view of a motor pump group according to another embodiment of the present invention which incorporates full-circumferential-flow in-line pumps.
Figure 3B:
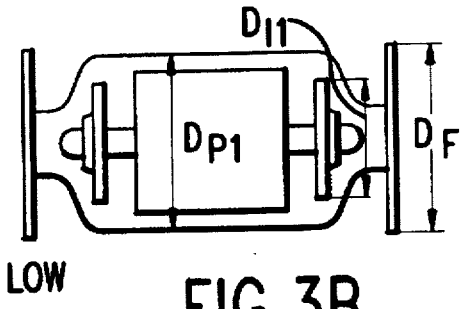
Figure 3C:
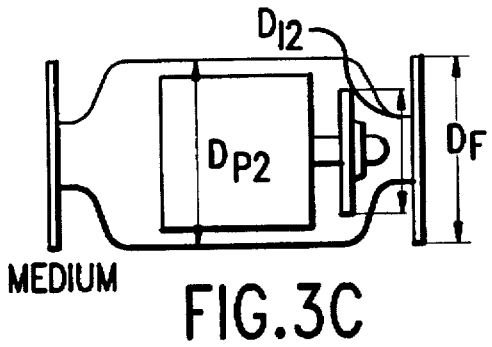
Figure 3D:
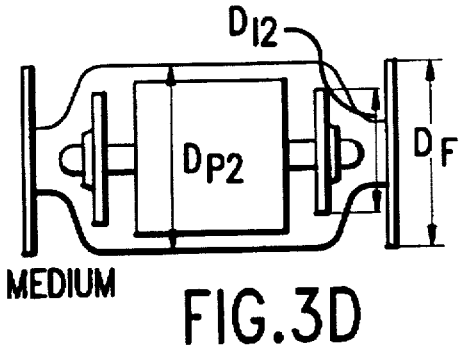
Figure 3E:
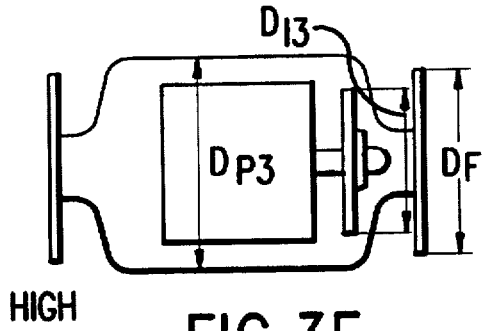
Figure 3F:
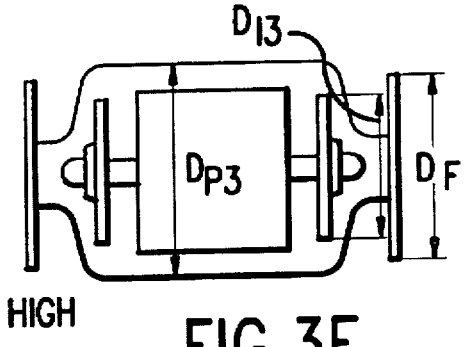

According to the present invention, as described above, each of the nominal ratio of the pump casing outside diameters $D_P$ and the nominal ratio of the impeller outside diameters $D_I$ is set to 1.12 or a similar value, and the heads of the low head section are handled by a plurality of single-stage impellers and the heads of the high head section are handled by sets of multiple-stage impellers. The absolute values of the outside diameters of the impellers are the same as the reference impeller outside diameters. However, as shown in FIG. 2, the heads are shifted one rank from a reference diameter ($\phi_1$) to an adjacent larger diameter ($\phi_2$). Specifically, the medium head of the low head section at the diameter ($\phi_1$) corresponds to the low head of the low head section at the diameter ($\phi_2$), and the high head of the low head section at the diameter ($\phi_1$) corresponds to the medium head of the low head section at the diameter ($\phi_2$). Similarly, the other heads are successively shifted one rank. The heads are also shifted one rank from the reference diameter ($\phi_2$) to an adjacent larger diameter ($\phi_3$). The heads are further shifted one rank from the reference diameter to adjacent larger diameter ($\phi_4$, $\phi_5$, . . . ).

FIG. 3 shows a motor pump group according to another embodiment of the present invention which incorporates full-circumferential-flow in-line pumps. The full-circumferential-flow in-line pump has an annular fluid passage between a pump casing and a motor accommodated in the pump casing. In FIG. 3, the motor pump group comprises impellers and pump casings which have stepwise greater outside diameters as with the motor pump group shown in FIG. 1. Each of the pump casings has a suction flange outside diameter $D_F$ which is substantially the same as the pump casing outside diameter $D_{P2}$ for the medium head in each of the low and high head sections. As with the graph shown in FIG. 2, the heads are shifted one rank from a reference diameter ($\phi_1$) to an adjacent larger diameter ($\phi_2$).

Figure 4:
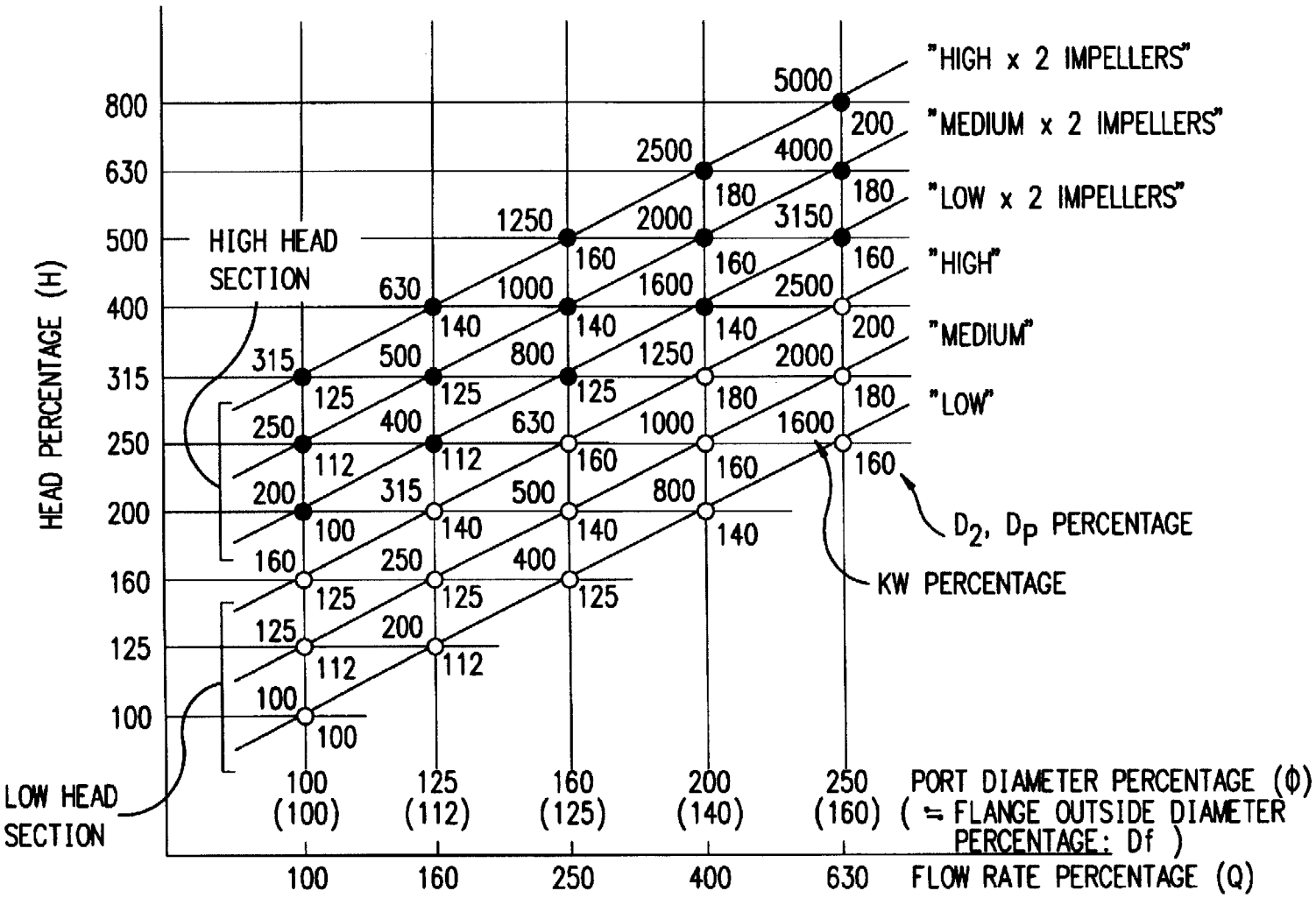
FIG. 4 is a diagram showing the relationship between flow rates (Q) and pump heads (H) with respect to changes in the diameter of the motor pump group shown in FIG. 3.
Figure 5A:
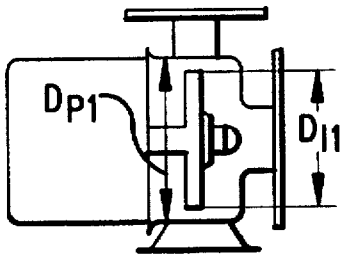
FIG. 5 is a view of a motor pump group according to still another embodiment of the present invention which incorporates horizontal centrifugal pumps.
Figure 5B:
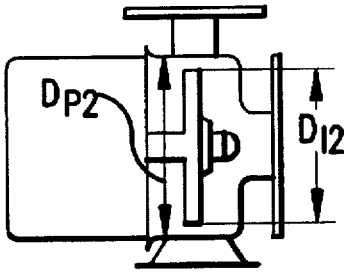
Figure 5C:
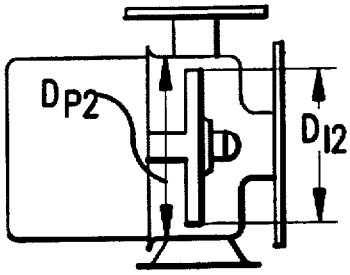
Figure 5D:
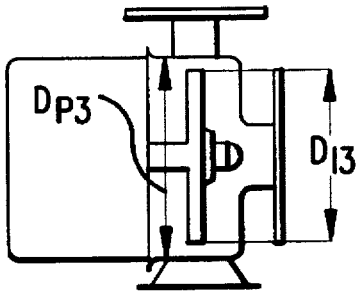
Figure 5E:
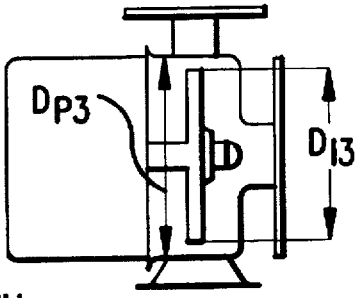
Figure 5F:
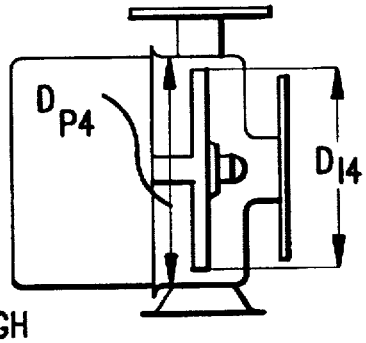

FIG. 4 shows the relationship between flow rates (Q) and pump heads (H) of a series of a motor pump group having the same nominal port diameter and a motor pump group having varying nominal port diameters. The horizontal axis of FIG. 4 represents a diameter percentage and the vertical axis thereof represents a pump head percentage. The series of motor pump groups has a minimum diameter represented by 100 and a minimum pump head represented by 100. The horizontal axis also indicates a flow rate percentage. The series of motor pump groups has a minimum flow rate represented by 100. It can be understood from FIG. 4 that since the nominal ratio of impeller outside diameters at the same diameter is set to 1.12 or a similar value, the pump head percentage is equal to a nominal ratio of $(1.12)^2=1.25$ or a similar value.

With respect to a change between adjacent diameters, the diameter nominal ratio is set to 1.25 or a similar value. The nominal ratio of flow rate percentages is set to the square of the diameter nominal ratio, i.e., $(1.25)^2=1.6$, or a similar value. The heads are shifted one rank from a reference diameter ($\phi_1$) to an adjacent larger diameter ($\phi_2$). As a whole, the motor pumps are arranged in a series such that three types in the low head section and three types in the high head section are each positioned on a straight line that is inclined upwardly to the right.

Motor pump groups according to other embodiments of the present invention will be described below with reference to the drawings.

According to the present invention, a motor pump group comprises a first group of centrifugal pumps having respective impellers of the same nominal port diameter ($\phi_1$) which have stepwise greater outside diameters and stepwise higher pump heads, and a second group of centrifugal pumps having respective impellers of the same nominal port diameter ($\phi_2$) greater than the nominal port diameter of the first group of centrifugal pumps, the centrifugal pumps of the second group having stepwise greater outside diameters and stepwise higher pump heads.

FIG. 5 shows a motor pump group according to still another embodiment of the present invention which incorporates pressed-sheet horizontal centrifugal pumps. The motor pump group shown in FIG. 5 comprises a first group of three centrifugal pumps of the same nominal port diameter ($\phi_1$) which have three (low, medium, and high) pump heads, and a second group of three centrifugal pumps of the same nominal port diameter ($\phi_2$) which is one step greater than the nominal port diameter of the first group of centrifugal pumps, the centrifugal pumps of the second group having three (low, medium, and high) pump heads.

The centrifugal pumps of the first group have respective impellers having respective outside diameters $D_{I1}$, $D_{I2}$, $D_{I3}$ that are stepwise greater in the order named to produce three pump heads, i.e., low, medium, and high pump heads. The centrifugal pumps of the second group have respective impellers having respective outside diameters $D_{I2}$, $D_{I3}$, $D_{I4}$ that are stepwise greater in the order named to produce three pump heads, i.e., low, medium, and high pump heads. The ratios between the impeller outside diameters $D_{I1}$, $D_{I2}$, $D_{I3}$, $D_{I4}$ which are stepwise greater in the order named are substantially equal to each other. That is, the nominal ratio of the impeller outside diameters is set to 1.12 or a similar value.

The impellers which have the impeller outside diameters $D_{I1}$, $D_{I2}$, $D_{I3}$, $D_{I4}$ are housed in respective pressed-sheet pump casings which have respective stepwise larger outside diameters $D_{P1}$, $D_{P2}$, $D_{P3}$, $D_{P4}$. The nominal ratio of the stepwise larger outside diameters $D_{P1}$, $D_{P2}$, $D_{P3}$, $D_{P4}$ is set to 1.12 or a similar value as with the nominal ratio of the impeller outside diameters.

Figure 6:
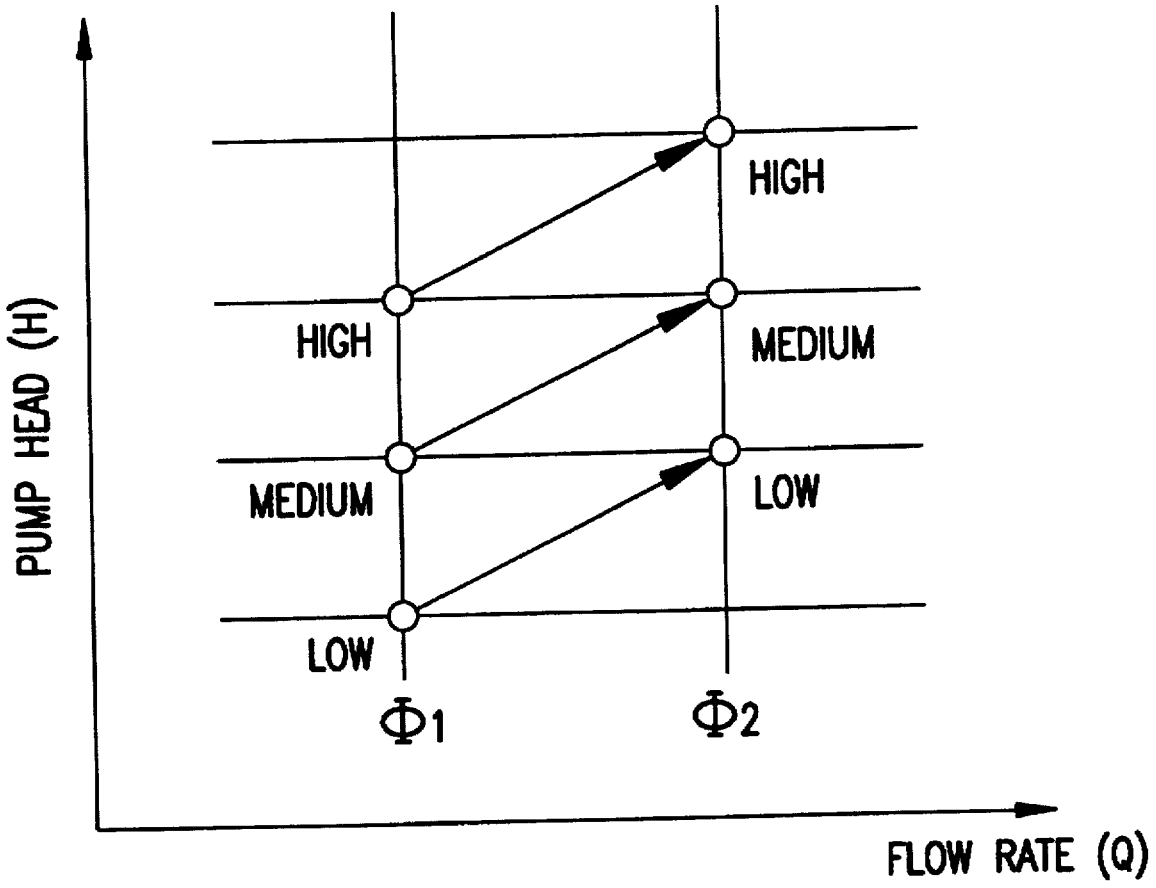
FIG. 6 is a diagram showing the relationship between flow rates (Q) and pump heads (H) with respect to changes in the diameter of the motor pump group shown in FIG. 5.
Figure 7A:
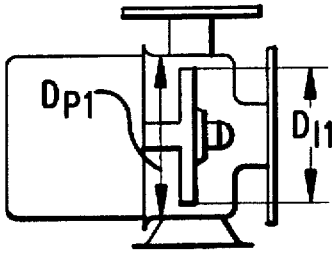
FIG. 7 is a view of a motor pump group according to a further embodiment of the present invention which incorporates horizontal centrifugal pumps.
Figure 7B:
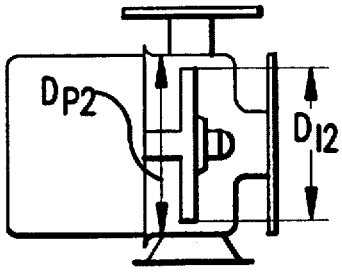
Figure 7C:
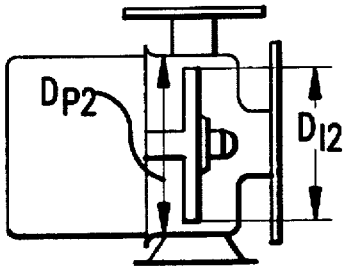
Figure 7D:
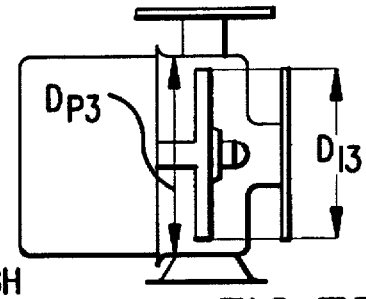
Figure 7E:
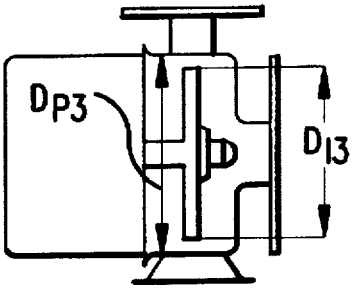
Figure 7F:
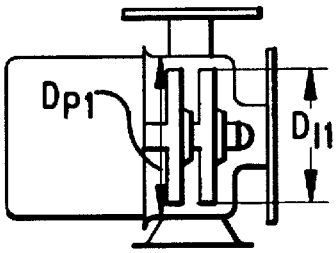
Figure 7G:
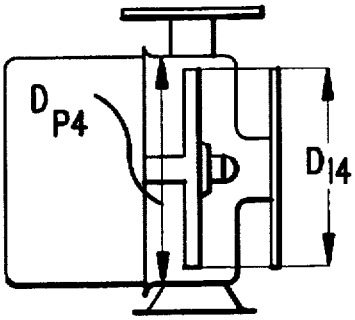
Figure 7H:
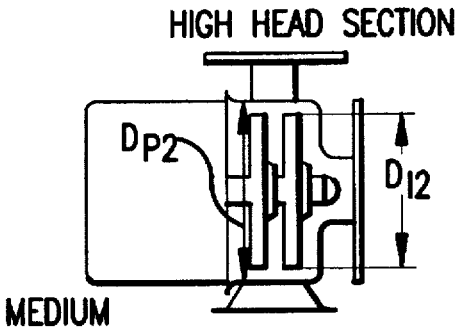
Figure 7I:
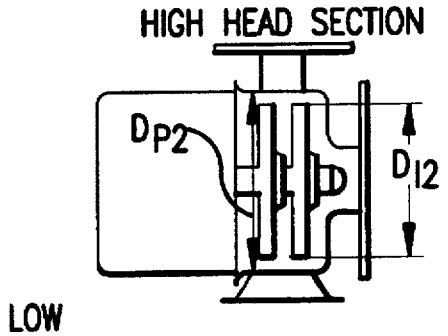
Figure 7J:
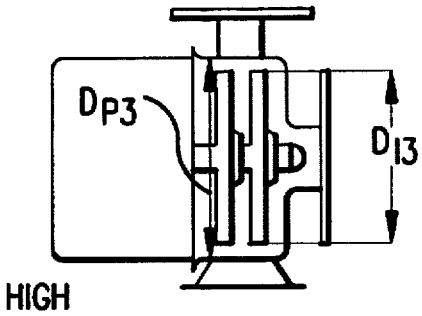
Figure 7K:
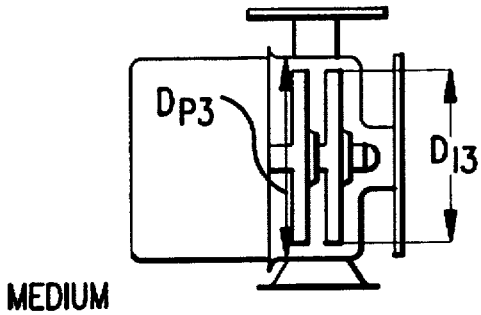
Figure 7L:
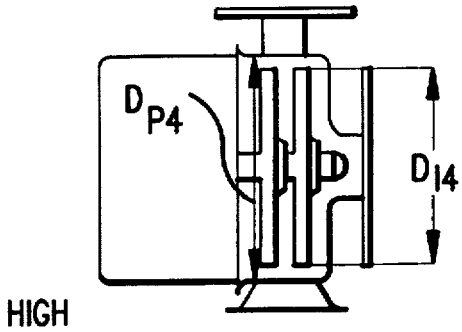
Figure 8A:
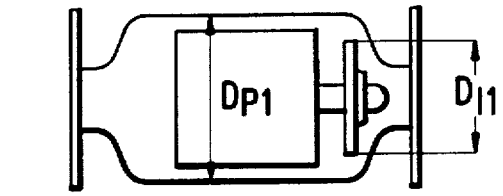
FIG. 8 is a view of a motor pump group according to a still further embodiment of the present invention which incorporates full-circumferential-flow in-line pumps.
Figure 8B:
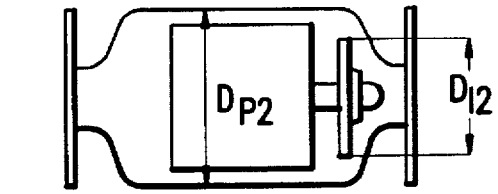
Figure 8C:
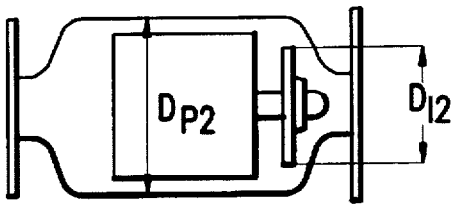
Figure 8D:
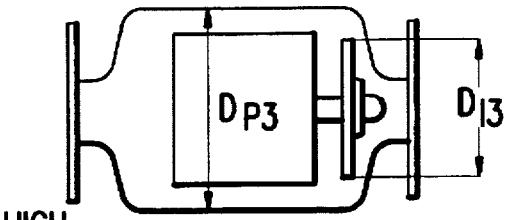
Figure 8E:
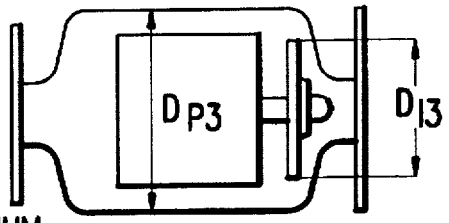
Figure 8F:
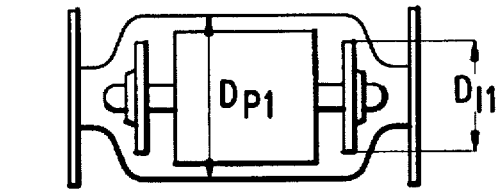
Figure 8G:
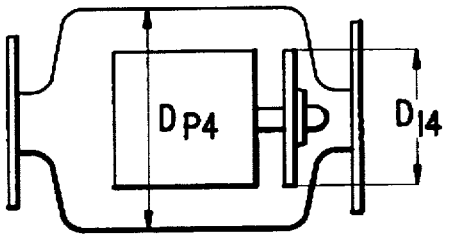
Figure 8H:
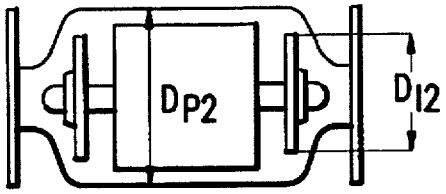
Figure 8J:
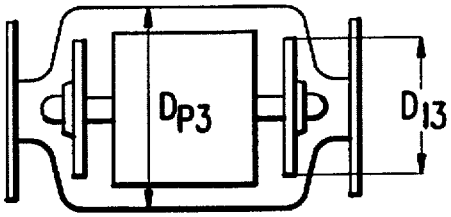
Figure 8I:
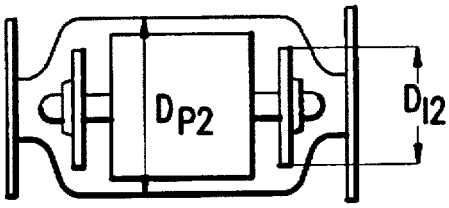
Figure 8K:
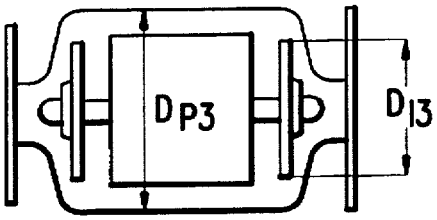
Figure 8L:
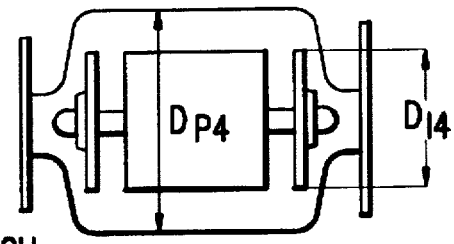

As shown in FIG. 6, the outside diameter of the impeller of a centrifugal pump of the second group is equal to the outside diameter of the impeller of a centrifugal pump of the second group which produces a pump head which is one step higher. Specifically, the outside diameter $D_{I2}$ of the impeller of the low head at the diameter ($\phi_2$) is equal to the outside diameter $D_{I2}$ of the impeller of the medium head at the diameter ($\phi_1$), and the outside diameter $D_{I3}$ of the impeller of the medium head at the diameter ($\phi_2$) is equal to the outside diameter $D_{I3}$ of the impeller of the high head at the diameter ($\phi_1$).

The nominal ratio between adjacent nominal port diameters which are stepwise greater, i.e., the nominal ratio of diameter changes of the first and second groups of centrifugal pumps, is set to 1.25 or a similar value as with the international standards. Specifically, the nominal diameters of suction ports are set to absolute values of 50, 65, 80, 100, 125, . . . (mm). The nominal ratio of flow rates of the first and second groups of centrifugal pumps is set to 1.6.

FIG. 7 shows a motor pump group according to a further embodiment of the present invention which incorporates pressed-sheet horizontal centrifugal pumps. In FIG. 7, the motor pump group comprises a first group of six centrifugal pumps having the same nominal port diameter and a second group of six centrifugal pumps having the same nominal port diameter which is one step greater than the nominal port diameter of the centrifugal pumps of the first group. The pump head range of each of the first and second groups of centrifugal pumps is divided into low and high head sections. The low head section is handled by a plurality of pumps having single-stage impeller, and the high head section is handled by a plurality of pumps having two-stage impellers. In the first group of centrifugal pumps, the low head section is handled by three single-stage impellers having respective outside diameters $D_{I1}$, $D_{I2}$, $D_{I3}$ that are stepwise greater in the order named to produce low, medium, and high pump heads, and the high head section is handled by three sets of two-stage impellers having respective outside diameters $D_{I1}$, $D_{I2}$, $D_{I3}$ that are stepwise greater in the order named to produce low, medium, and high pump heads.

In the second group of centrifugal pumps, the low head section is handled by three single-stage impellers having respective outside diameters $D_{I2}$, $D_{I3}$, $D_{I4}$ that are stepwise greater in the order named to produce low, medium, and high pump heads, and the high head section is handled by three sets of two-stage impellers having respective outside diameters $D_{I2}$, $D_{I3}$, $D_{I4}$ that are stepwise greater in the order named to produce low, medium, and high pump heads. The nominal ratios between the stepwise greater outside diameters $D_{I1}$, $D_{I2}$, $D_{I3}$, $D_{I4}$ of the impellers are set to 1.12 or a similar value.

The impellers which have the impeller outside diameters $D_{I1}$, $D_{I2}$, $D_{I3}$, $D_{I4}$ are housed in respective pressed-sheet pump casings which have respective stepwise larger outside diameters $D_{P1}$, $D_{P2}$, $D_{P3}$, $D_{P4}$. The nominal ratio of the stepwise larger outside diameters $D_{P1}$, $D_{P2}$, $D_{P3}$, $D_{P4}$ is set to 1.12 or a similar value as with the nominal ratio of the impeller outside diameters.

As shown in FIG. 7, the outside diameter of the impeller of a centrifugal pump of the second group is equal to the outside diameter of the impeller of a centrifugal pump of the second group which produces a pump head that is one step higher. Specifically, the outside diameter $D_{I2}$ of the impeller of the low head of the low head section at the diameter ($\phi_2$) is equal to the outside diameter $D_{I2}$ of the impeller of the medium head of the low head section at the diameter ($\phi_1$), and the outside diameter $D_{I3}$ of the impeller of the medium head of the low head section at the diameter ($\phi_2$) is equal to the outside diameter $D_{I3}$ of the impeller of the high head of the low head section at the diameter ($\phi_1$). However, no impeller exists in the low head section at the diameter ($\phi_1$) which would correspond to the outside diameter $D_{I4}$ of the impeller of the high head of the low head section at the diameter ($\phi_2$). The outside diameter $D_{I2}$ of the two-stage impellers of the low head of the high head section at the diameter ($\phi_2$) is equal to the outside diameter $D_{I2}$ of the two-stage impellers of the medium head of the high head section at the diameter ($\phi_1$), and the outside diameter $D_{I3}$ of the two-stage impellers of the medium head of the high head section at the diameter ($\phi_2$) is equal to the outside diameter $D_{I3}$ of the two-stage impellers of the high head of the high head section at the diameter ($\phi_1$). However, no impeller exists in the high head section at the diameter ($\phi_1$) which would correspond to the outside diameter $D_{I4}$ of the two-stage impellers of the high head of the high head section at the diameter ($\phi_2$).

The nominal ratios between adjacent nominal port diameters which are stepwise greater and the nominal ratios between flow rate changes are set to 1.25 and 1.6, respectively, as with the embodiments shown in FIGS. 5 and 6.

FIG. 8 shows a motor pump group according to a still further embodiment of the present invention which incorporates full-circumferential-flow in-line pumps. The motor pump group shown in FIG. 8 comprises a first group of six centrifugal pumps and a second group of six centrifugal pumps. The centrifugal pumps of the first group have respective outside diameters $D_{I2}$, $D_{I2}$, $D_{I3}$ which are stepwise greater, and the centrifugal pumps of the second group have respective outside diameters $D_{I2}$, $D_{I3}$, $D_{I4}$ which are stepwise greater. The centrifugal pumps of the first group are housed in respective pump casings which have respective stepwise larger outside diameters $D_{P1}$, $D_{P2}$, $D_{P3}$, and the centrifugal pumps of the second group are housed in respective pump casings which have respective stepwise larger outside diameters $D_{P2}$, $D_{P3}$, $D_{P4}$. The outside diameters $D_{I1}$, $D_{I2}$, $D_{I3}$, $D_{I4}$ of the impellers, and the outside diameters $D_{P1}$, $D_{P2}$, $D_{P3}$, $D_{P4}$ of the pump casings are related to each other as with the embodiment shown in FIG. 7.

Figure 9:
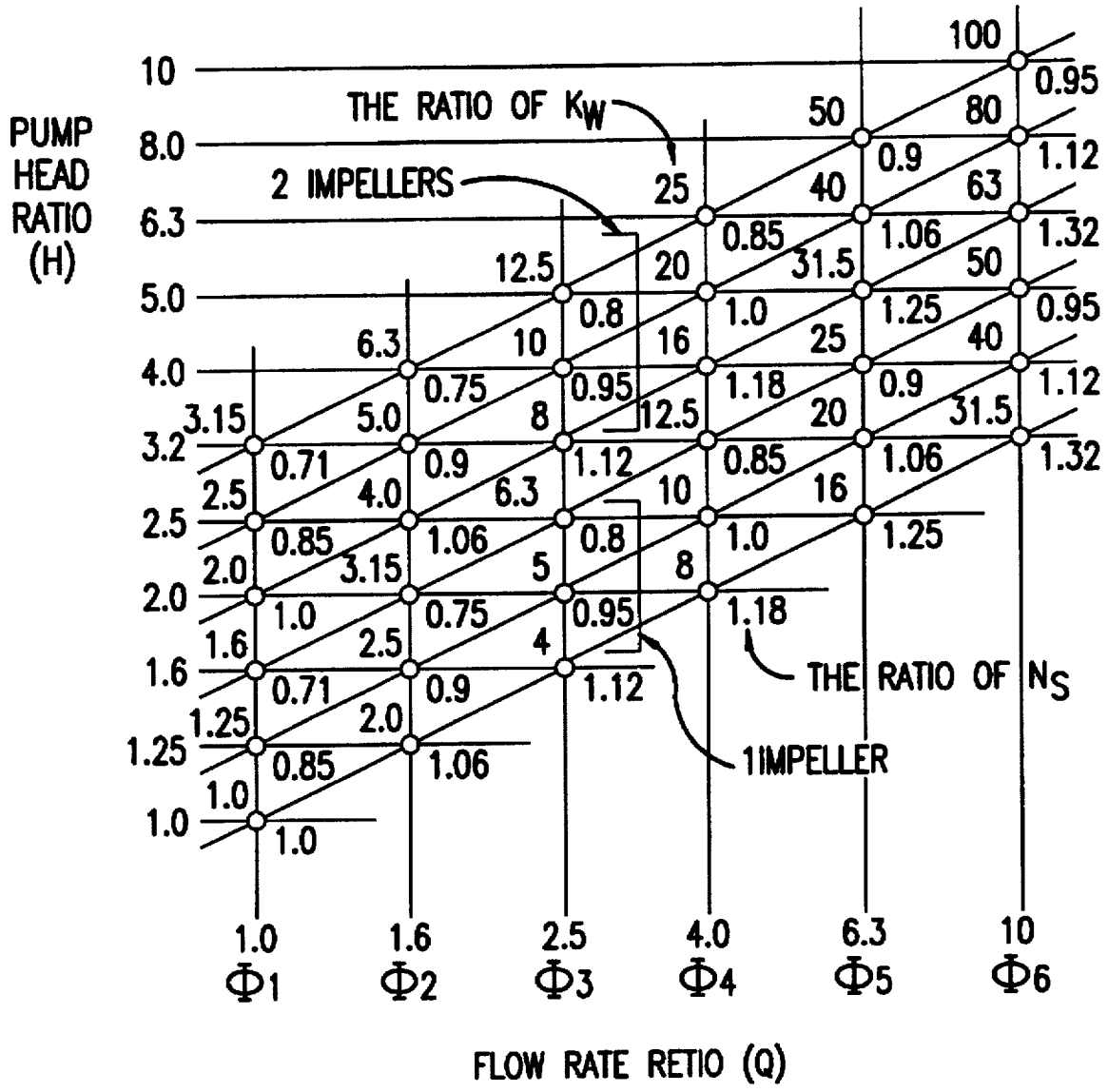
FIG. 9 is a diagram showing the relationship between flow rates (Q), pump heads (H), and specific speeds (Ns) of the motor pump group shown in FIG. 7 or 8.

FIG. 9 shows the relationship between flow rates (Q), pump heads (H), and specific speeds (Ns) of a series of a first group of centrifugal pumps having the same nominal port diameter and a second group of centrifugal pumps having the same nominal port diameter which is one step greater than the nominal port diameter of the centrifugal pumps of the first group, as shown in FIG. 7 or 8. In FIG. 9, the horizontal axis represents a flow rate ratio and the vertical axis represents a pump head ratio. The minimum flow rate of the series of motor pump groups is represented by 1 and the minimum pump head by 1. Inasmuch as the nominal ratio of the outside diameters of the impellers at the same diameter is set to 1.12 or a similar value, the pump head nominal ratio is set to $(1.25)^2=1.25$ or a similar value.

With respect to a change between adjacent diameters, the diameter nominal ratio is set to 1.25 or a similar value. The nominal ratio of flow rates is set to the square of the diameter nominal ratio, i.e., $(1.25)^2=1.6$, or a similar value. The heads are shifted one rank from a reference diameter ($\phi_1$) to an adjacent larger diameter ($\phi_2$). As a whole, the motor pumps are arranged in a series such that three types in the low head section and three types in the high head section are positioned on a straight line that is inclined upwardly to the right. Numerical values given downward and rightward of the points of intersection between the straight lines that are inclined upwardly to the right and horizontal lines indicative of pump heads represent the ratio of specific speeds (Ns) of the impellers. It will be understood from these numerical values that the ratio of the specific speeds (Ns) are in the range of from 0.71 to 1.32. Therefore, the specific speeds fall in a range suitable for pressed-sheet impellers. Numerical values given upward and leftward of the points of intersection represent the ratio of motor output (kw) of the pumps. It can be seen from these numerical values that the motor output at a smaller diameter and the motor output at an adjacent larger diameter are in agreement with each other at pump heads at larger diameters which are two steps lower than pump heads at smaller diameters. For example, the ratio of the motor output (2.0) at the low head of the high head section at the smaller diameter ($\phi_1$) corresponds to the ratio of the motor output (2.0) at the low head of the low head section at the larger diameter ($\phi_2$).

Figure 10:
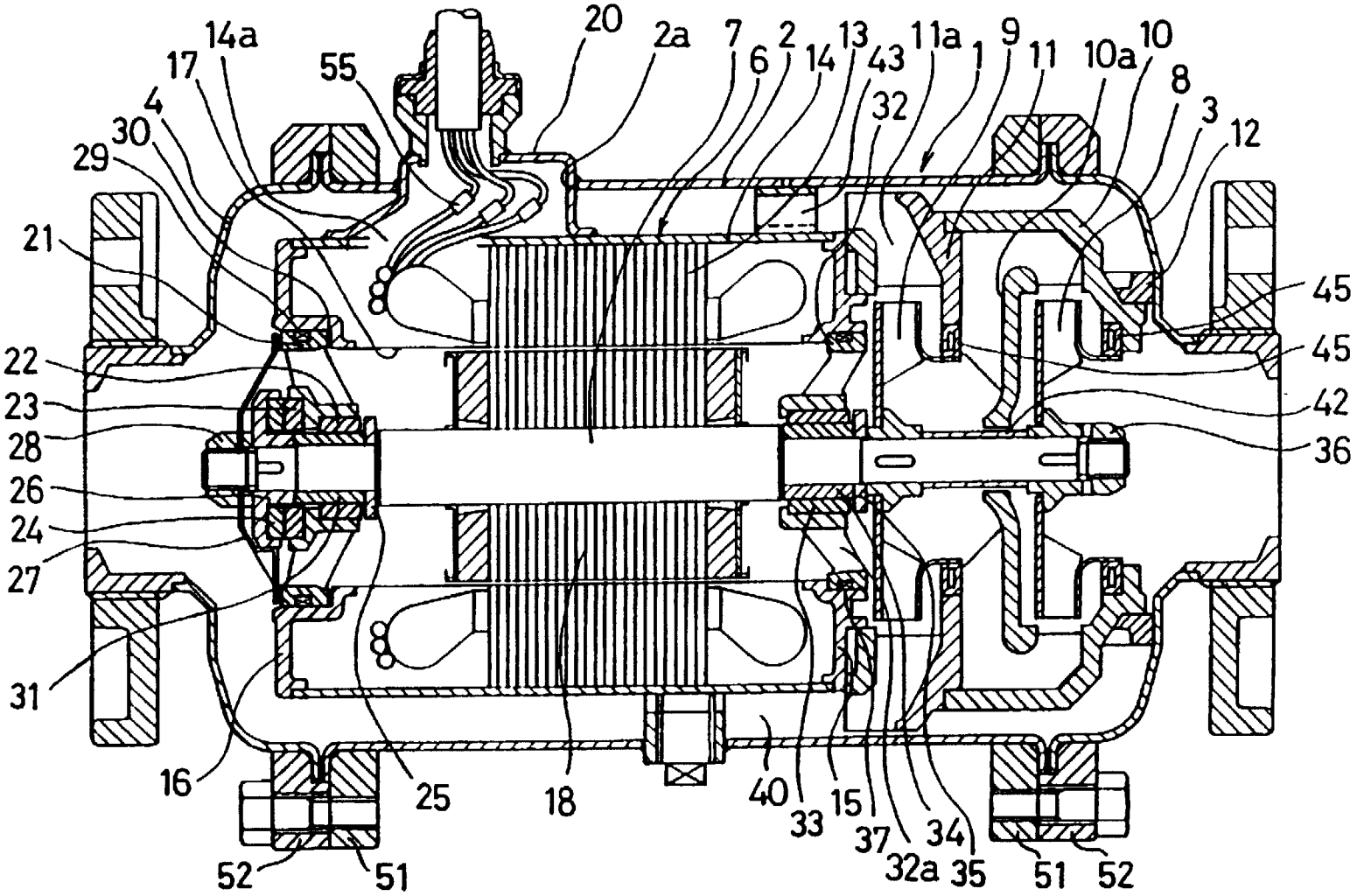
FIG. 10 is a cross-sectional view of a pump which may preferably be employed in a motor pump group according to the present invention.

A pump which may preferably be employed in a motor pump group according to the present invention will be described below with reference to FIG. 10. FIG. 10 shows in cross section a full-circumferential-flow pump which comprises a pump casing 1, a canned motor 6 housed in the pump casing 1, and a pair of impellers 8, 9 fixedly mounted on a main shaft 7 of the canned motor 6. The pump casing 1 comprises an outer casing member 2, a suction casing member 3 connected to an axial end of the outer casing member 2 by flanges 51, 52, and a discharge casing member 4 connected to an opposite axial end of the outer casing member 2 by flanges 51, 52. Each of the outer casing member 2, the suction casing member 3, and the discharge casing member 4 is made of a pressed sheet of stainless steel or the like.

The impeller 8 is housed in a first inner casing 10 having a return vane 10*a*, the first inner casing 10 being disposed in the pump casing 1. The impeller 9 is housed in a second inner casing 11 having a guide device 11*a*, and the second inner casing 11 is disposed in the pump casing 1 and connected to the first inner casing 10. A resilient seal 12 is interposed between the first inner casing 10 and the suction casing member 3. Liner rings 45 are mounted on radially inner ends 45, respectively, of the first and second inner casings 10, 11.

The canned motor 6 comprises a stator 13, an outer motor frame barrel 14 fixedly fitted over the stator 13 and securely disposed in the pump casing 1, a pair of motor frame side plates 15, 16 welded to respective opposite open ends of the outer motor frame barrel 14, and a can 17 fitted in the stator 13 and welded to the motor frame side plates 15, 16. The canned motor 6 also has a rotor 18 rotatably disposed in the stator 13 and hence the can 17, and shrink-fitted over the main shaft 7.

A cable housing 20 is welded to the outer motor frame barrel 14. Leads from coils disposed in the outer motor frame barrel 14 are extended and connected to a power supply cable in the cable housing 20.

The pump has an anti-thrust load bearing assembly and a thrust load bearing assembly.

First, the anti-thrust load bearing assembly will be described below. A radial bearing 22 and a fixed thrust bearing 23 are mounted on a bearing bracket 21 near the discharge casing member 4. The radial bearing 22 has an end which serves as a fixed thrust sliding member. A rotary thrust bearing 24 serving as a rotary thrust sliding member and a thrust collar 25 are disposed one on each side of the radial bearing 22 and the fixed thrust bearing 23. The rotary thrust bearing 24 is secured to a thrust disk 26 which is fixed to the main shaft 7 through a sand shield 27 by a nut 28 threaded over an externally threaded surface on an end of the main shaft 7.

The bearing bracket 21 is inserted in a socket defined in the motor frame side plate 16 through a resilient O-ring 29. The bearing bracket 21 is also held against the motor frame side plate 16 through a resilient gasket 30. The radial bearing 22 is slidably supported on a sleeve 31 which is fitted over the main shaft 7.

The thrust load bearing assembly will now be described below. A radial bearing 33 is mounted on a bearing bracket 32 near the impeller 9, and slidably supported on a sleeve 34 which is fitted over the main shaft 7. The sleeve 34 is axially held against a washer 35 which is fixed the main shaft 7 through the impeller 9, a sleeve 42, and the impeller 8 by a nut 36 threaded over an externally threaded surface on an opposite end of the main shaft 7. The bearing bracket 32 is inserted in a socket defined in the motor frame side plate 15 through a resilient O-ring 37. The bearing bracket 32 is also held against the motor frame side plate 15.

Operation of the full circumferential-flow pump shown in FIG. 10 will be described below. A fluid drawn into the suction casing 3 is pressurized by the impellers 8, 9, and oriented from a radial direction into an axial direction by the guide device 11*a*. Therefore, the fluid flows into an annular passage 40 defined between the outer casing member 2 and the outer motor frame barrel 14, and then flows through the annular passage 40 into the discharge casing member 4. From the discharge casing member 4, most of the fluid is discharged through a discharge port out of the pump. The remaining fluid passes behind the sand shield 27 into a rotor chamber in which it lubricates the bearings 22, 23, 24, 35. Thereafter, the fluid flows through an opening 32*a* defined in the bearing bracket 32, and joins the fluid which is discharged from the impeller 9.

Generally, a three-phase induction motor which can operate at both 50 Hz and 60 Hz under the same voltage has essentially the same efficiency at both 50 Hz and 60 Hz. The power factor of the three-phase induction motor is better at 60 Hz than at 50 Hz (the power factor at 60 Hz is 1.05 to 1.1 times the power factor at 50 Hz).

Therefore, if the motor is supplied with the same current at 50 Hz and 60 Hz, then the motor produces a greater output power when it is used at 60 Hz than at 50 Hz.

$$(\text{Motor output at 60 Hz})=[(\text{motor efficiency at 60 Hz})\times(\text{motor power factor at 60 Hz})/(\text{motor efficiency at 50 Hz})\times(\text{motor power factor at 50 Hz})]\times(\text{motor output at 50 Hz})=1.05\text{–}1.1.$$

The output power up to which a given motor can be used is determined generally depending on the temperature of the stator windings. Since the amount of heat generated by the stator windings is determined by the current flowing therethrough, the motor can be used up to a greater output power at 60 Hz than at 50 Hz (the output power at 60 Hz is 1.05–1.1 times greater than the output power at 50 Hz).

However, in general, as the rotational speed of a motor increases, the heat produced by the bearings and caused by other mechanical losses also increases, and interferes with the temperature of the stator windings. As a result, the motor can be used up to substantially the same output power at both 50 Hz and 60 Hz.

It is assumed that there is a pump which consumes a power of P when used at 50 Hz. If the pump is used at 60 Hz, then it consumes a power of 1.73 P as indicated by the following equation:

$$(\text{Power consumed by a pump at 60 Hz})=[60\text{ Hz}/50\text{ Hz}]^3\times(\text{power consumed by the pump at 50 Hz}).$$

However, no motor with an output of 1.73 P exists as shown in Tables 2, 3, and 4. Heretofore, a pump for use at 60 Hz has been realized in one of the following fashions:

(1) A pump which consumes a power of 1.73 P is connected to a motor with an output of 2 P.

(2) A pump which consumes a power of 1.73 P is connected to a motor with an output of 1.6 P. Since the temperature of stator windings of the motor becomes too high, the outside diameter of impellers is reduced by subsequent machining.

The approach (1) is wasteful because the motor produces an excessive power. The approach (2) impairs the productivity as it requires impellers for use at 60 Hz. If the impellers are produced by pressing, then since subsequent machining of the impellers to reduce the outside diameters of the impellers is impossible to carry out, it is necessary to employ dies for making impellers for use at both 50 Hz and 60 Hz. Another problem with the approach (2) is that the pump performance is lowered.

According to the present invention, as shown in FIG. 10, the pump is self-lubricated to prevent the heat produced by the bearings and the heat caused by other mechanical losses from affecting the temperature of the stator windings. As a result, the motor can produce an output power at 60 Hz which is 1.05–1.1 times greater than the output power produced at 50 Hz. Inasmuch as the flow rate nominal ratio is 1.6 according to the present invention, there already exists a motor which can be used to produce an output power of 1.6 P at 50 Hz. When this motor is used at 60 Hz, it can be used up to an output power of 1.6 P×(1.05–1.1)=approximately 1.73 P.

Consequently, a complete pump for use at 60 Hz can be manufactured efficiently without waste simply by modifying a combination of a pump and a motor produced for use at 50 Hz.

The present invention offers the following advantages:

Since a pump head region divided into a low head section and a high head section, and the low head section is handled by a single-stage impeller, and the high head section is handled by multi-stage impellers, it is not necessary to increase the outside diameters of the impellers in the high head section at the same nominal port diameter, and also to increase the outside diameter of the pump casing. Consequently, if a series of pumps are made available at the same nominal port diameter, then the outside diameters of the pump casings can be placed in a relatively small range, and the series of pumps is suitable for pressed-sheet pump casings with reduced rigidity.

The low head section is handled by a plurality of single-stage impellers to produce a plurality of pump heads, and the high head section is handled by a plurality of sets of multi-stage impellers to produce a plurality of pump heads. Thus, some shared components such as pump casings, impellers, and their related parts may be used for low pump heads of the low and high head sections, medium pump heads of the low and high head sections, and high pump heads of the low and high head sections. Consequently, the number of components of the series of pumps may be reduced.

Since the nominal ratio of impeller outside diameters is set to 1.12 or a similar value, the nominal ratio of pump heads is $(1.12)^2=1.25$ or a similar value. Therefore, pump heads can be selected in smaller increments than according to the conventional international standards.

If a motor pump group according to the present invention incorporates a full-circumferential-flow in-line pumps, then the outside diameters of suction flanges are substantially equal or close to pump casing outside diameters, so that the motor pump group is a space saver with no dead space included in the radial direction.

In a group of motor pumps having adjacent nominal port diameters, the outside diameter of an impeller of a pump having a greater nominal port diameter is equal to the outside diameter of an impeller of a pump having a smaller nominal port diameter for a pump head that is one step higher. For example, if a motor pump group has a port diameter ($\phi_1$) and an adjacent larger port diameter ($\phi_2$), and three pump heads (low, medium, and high), then the outside diameter of an impeller of the low head at the port diameter ($\phi_2$) is equal to the outside diameter of the impeller of the medium head at the diameter port ($\phi_1$), and the outside diameter of the impeller of the medium head at the port diameter ($\phi_2$) is equal to the outside diameter of the impeller of the high head at the port diameter ($\phi_1$). Similarly, the other heads are successively shifted one rank. Inasmuch as the outside diameter of an impeller at the smaller port diameter ($\phi_1$) is equal to the outside diameter of an impeller at the larger port diameter ($\phi_2$) for pump heads which are one step different from each other, impellers, pump casings, and their related parts can be shared, and the number of components of the series of pumps can be reduced.

Furthermore, since the nominal ratio of port diameter changes is 1.25, the nominal ratio of area changes is $(1.25)^2=1.6$. As the nominal ratio of flow rates is 1.6, the speeds of flow at various diameters are constant, and the pressure loss is not increased even if the diameter is increased.

For the same pump head, the nominal ratio of motor output powers (kw) with respect to port diameter changes is about 1.6 or a similar value. As the nominal ratio of 1.6 corresponds to $(1.25)^2$, it is the same as increments of an output nominal ratio $(1.25)^n$ at the port diameter ($\phi_1$), resulting in the same series of motor outputs. Specifically, a motor output at the port diameter ($\phi_1$) and a motor output at the adjacent larger port diameter ($\phi_2$) agree with each other at a pump head at the port diameter ($\phi_2$) which is two steps lower than a pump head at the port diameter ($\phi_1$). Where the motor outputs agree with each other, the motors can be shared.

In the manufacture of pumps of a high head section, the impellers of pumps of a low head section can be used. Specifically, for producing a group of pumps ranging from those of the low head section to those of the high head section, it is possible to reduce to half the number of components including impellers, pump casings, and their related parts. Because the outside diameters of the impellers of pumps of the high head section and hence the casings thereof can be reduced, the rigidity of the casings is not lowered even if the casings are made of pressed sheet.

Since the nominal ratio of pump port diameters is set to about 1.25 and the nominal ratio of flow rates is set to about 1.6, the port-diameter-to-area nominal ratio ($1.25^2=1.6$) is equal to the nominal ratio of flow rates, allowing the same flow speed in the pipes at any of the port diameters, and preventing the pressure loss from being increased even if the port diameter is increased.

As can be seen from Table 4 (which shows the relationship between particulars and outputs with K=1.6, n=1), 16 particulars can be handled by 7 types of motors. A comparison between Tables 2 and 4 clearly indicates that the number of types of motors required to satisfy the same range of particulars is much smaller than the number of types of motors required by the conventional international standards.

Moreover, since the pumps employ self-lubricated motors according to the present invention, the heat produced by the bearings is not transferred to affect the temperature of the stator windings. This allows motors for use at 50 Hz and 60 Hz to be shared.

Figure 11:
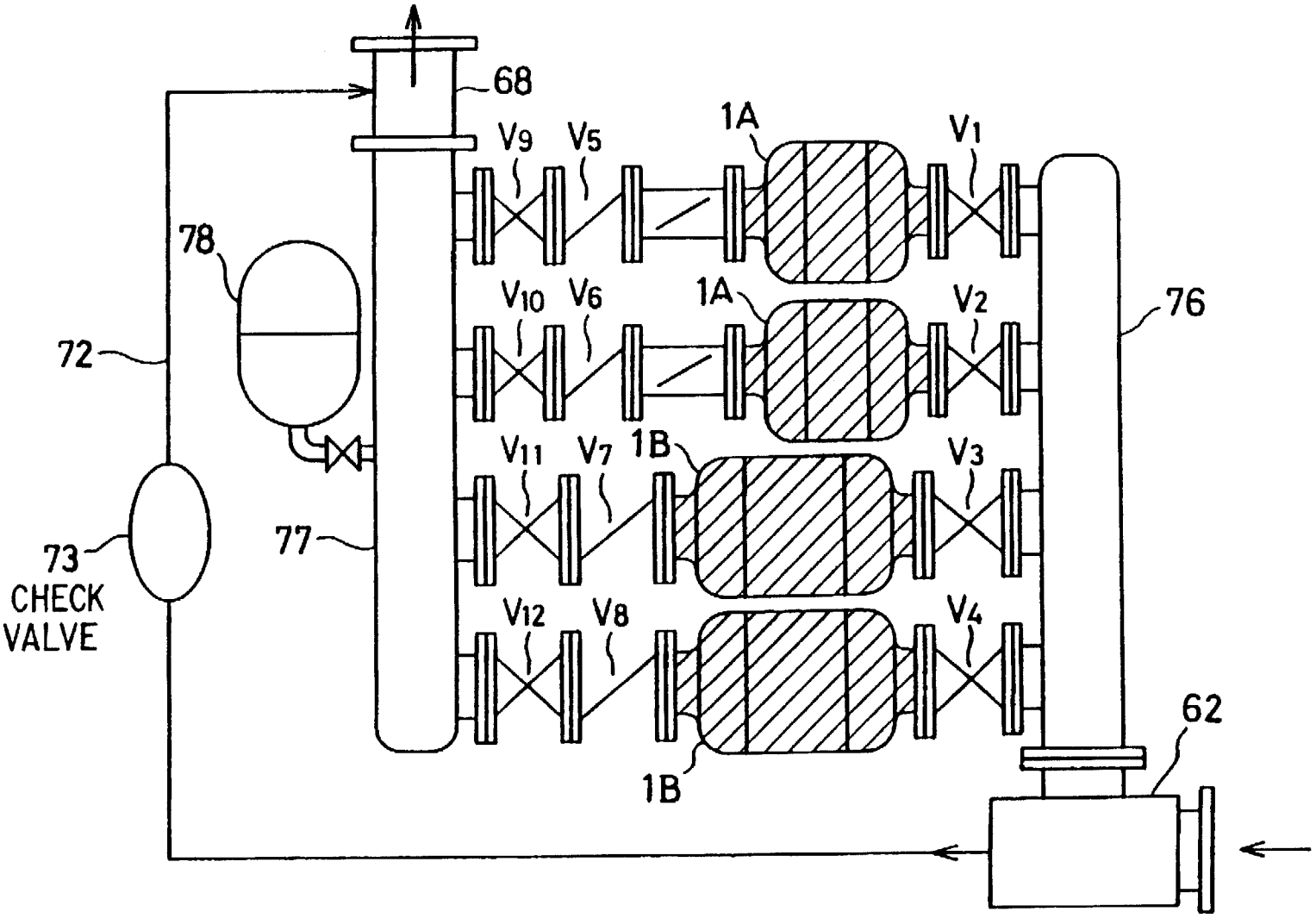
FIG. 11 is a schematic view of a feed water pump system according to an embodiment of the present invention.

Next, a feed water pump system using the motor pump group in FIGS. 1 through 10 will be described below with reference to FIGS. 11 through 15. The feed water pump system comprises a plurality of pumps which are operated in parallel. FIG. 11 shows a feed water pump system according to an embodiment of the present invention. As shown in FIG. 11, four pumps 1A and 1A and 1B and 1B are provided in parallel. The two pumps 1A and 1A constitute a first pump set, and the two pumps 1B and 1B constitute a second pump set. The flow rate of the pump 1B is larger than that of the pump 1A. The nominal ratio of the flow rate of the pump 1A to the flow rate of the pump 1B is in the range of 1.4 to 1.6, and preferably 1.6. In the feed water pump system, the number of pumps which are to be in operation is controlled to feed required water consumption while keeping delivery pressure or discharge pressure constant.

The suction sides of the pumps 1A, 1A, 1B and 1B are connected to a suction header 76 through valves V1, V2, V3 and V4, respectively. A fluid control device 62 are provided at the inlet side of the suction header 76. The discharge sides of the pumps 1A, 1A, 1B and 1B are connected to a discharge header 77 through check valves $V_5$, $V_6$, $V_7$ and $V_8$ and gate valves $V_9$, $V_{10}$, $V_{11}$ and $V_{12}$. A pressure tank 78 is provided on the discharge header 77. A negative pressure generating device 68 is provided at the discharge side of the discharge header 77. The negative pressure generating device 68 is connected to the fluid control device 62 by a bypass pipe 72 having a check valve 73.

Figure 12:
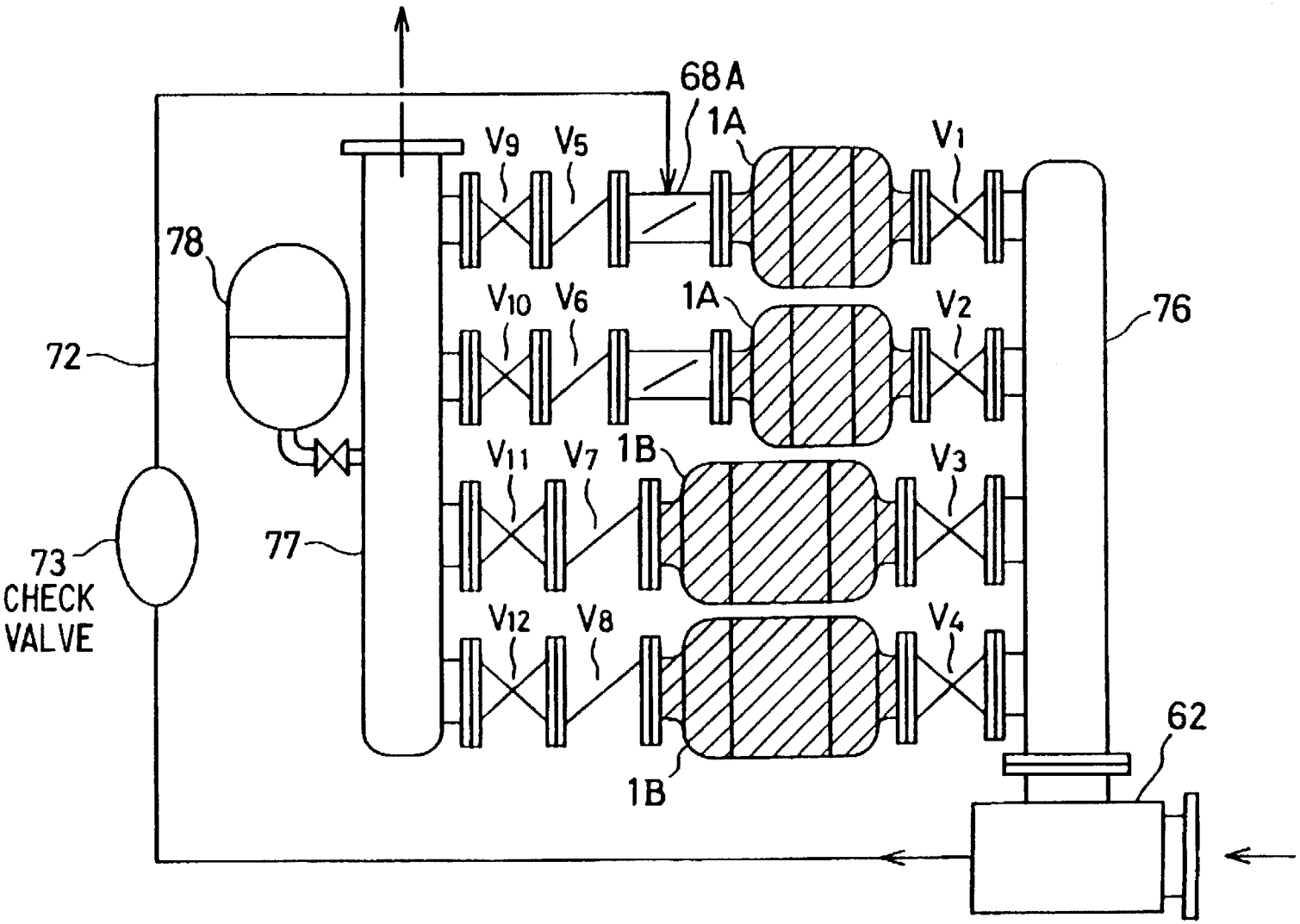
FIG. 12 is a schematic view of a feed water pump system according to another embodiment of the present invention.

FIG. 12 shows a feed water pump system according to another embodiment of the present invention. In this embodiment, the fluid control device 62 is connected to the negative pressure generating device 68A provided at the discharge side of the pump 1A by a bypass pipe 72 having a check valve 73. The other structure is the same as that of FIG. 11.

In the embodiment in FIGS. 11 and 12, the four pumps 1A, 1A, 1B and 1B are provided in a panel type. The pumps 1A, 1A, 1B and 1B are of an in-line type which has a suction port and a discharge port in line with each other. Two kinds of pumps 1A and 1B have the same outer diameter, a different diameter of a suction port or a discharge port and a different total length. As a result, the feed water pump system can be a thin type and save an installation space.

Next, the reason why the two pumps 1A and the two pumps 1B are provided and the nominal ratio of the flow rate of the pump 1A to the flow rate of the pump 1B is preferably 1.6 will be described below.

First, in order to find optimum combination, various combinations will be exemplified.

TABLE 9

Combination 1:
$Q_1 = 1.0 \times 3$ pumps,
$Q_2 = 1.6 \times 1$ pump

| The number of pumps to be in operation | Flow rate |
|---|---|
| 1 | $Q_1 = 1.0$ |
| 1 | $Q_2 = 1.6$ |
| 2 | $Q_1 \times 2 = 2.0$ |
| 2 | $Q_1 + Q_2 = 1 + 1.6 = 2.6$ |
| 3 | $Q_1 \times 3 = 3$ |
| 3 | $Q_1 \times 2 + Q_2 \times 1 = 1 \times 2 + 1.6 \times 1 = 3.6$ |
| 4 | $Q_1 \times 3 + Q_2 \times 1 = 1 \times 3 + 1.6 \times 1 = 4.6$ |

As is apparent from the above, seven flow rate patterns are obtained, and $Q_2$ pump is frequently used compared with $Q_1$ pump because there is provided only one $Q_1$ pump.

In the case where the number of flow rate patterns is large and maximum flow rate is small, the pump are efficiently in operation. Therefore, various combination will be evaluated by absolute number. Here, the absolute number is defined as "the number of flow rate patterns divided by maximum flow rate".

In combination 1, the absolute number=the number of flow rate patterns/maximum flow rate=7/4.6=1.52

Combination 2 is shown in Table 5.

In this case, eight flow rate patterns are obtained. The absolute number=the number of flow rate patterns/maximum flow rate=8/5.2=1.54 Therefore, in combination 2, it is possible to operate the pumps efficiently in accordance with the required water consumption. Further, the difference between the upper and lower flow rates is substantially equivalent, thus the flow rate can be finely controlled.

TABLE 10

Combination 3:
$Q_1 = 1.0 \times 2$ pumps, $Q_2 = 1.6 \times 1$ pump,
$Q_3 = 2.5 \times 1$ pump ($2.5 = 1.6^2$)

| The number of pumps to be in operation | Flow rate |
|---|---|
| 1 | $Q_1 = 1.0$ |
| 1 | $Q_2 = 1.6$ |
| 1 | $Q_3 = 2.5$ |
| 2 | $Q_1 \times 2 = 2.0$ |
| 2 | $Q_1 + Q_2 = 2.6$ |
| 2 | $Q_1 + Q_3 = 3.5$ |
| 2 | $Q_2 + Q_3 = 4.1$ |
| 3 | $Q_1 \times 2 + Q_2 \times 1 = 3.6$ |
| 3 | $Q_1 \times 2 + Q_3 \times 1 = 4.5$ |
| 3 | $Q_1 + Q_2 + Q_3 = 5.1$ |
| 4 | $Q_1 \times 2 + Q_2 + Q_3 = 6.1$ |

Thus, nine flow rate patterns are obtained.

The absolute number=9/6.1=1.48

TABLE 11

Combination 4:
$Q_1 = 1.0 \times 1$ pump,
$Q_2 = 1.6 \times 3$ pumps

| The number of pumps to be in operation | Flow rate |
|---|---|
| 1 | $Q_1 = 1.0$ |
| 1 | $Q_2 = 1.6$ |
| 2 | $Q_1 + Q_2 = 2.6$ |
| 2 | $Q_2 \times 2 = 3.2$ |
| 3 | $Q_1 \times Q_2 \times 2 = 4.2$ |
| 3 | $Q_2 \times 3 = 4.8$ |
| 4 | $Q_1 \times 1 + Q_2 \times 3 = 5.8$ |

Thus, seven flow rate patterns are obtained, and the $Q_1$ pump is frequently used compared with the $Q_2$ pump because there is only one $Q_1$ pump.

The absolute number=7/5.8=1.21

TABLE 12

Combination 5:
$Q_1 = 1.0 \times 1$ pump, $Q_2 = 1.6 \times 2$ pumps,
$Q_3 = 2.5 \times 1$ pump

| The number of pumps to be in operation | Flow rate |
|---|---|
| 1 | $Q_1 = 1.0$ |
| 1 | $Q_2 = 1.6$ |
| 1 | $Q_3 = 2.5$ |
| 2 | $Q_1 + Q_2 = 2.6$ |
| 2 | $Q_2 \times 2 = 3.2$ |
| 2 | $Q_1 + Q_3 = 3.5$ |
| 2 | $Q_{2+Q3} = 4.1$ |
| 3 | $Q_1 \times 1 + Q_2 = 4.2$ |
| 3 | $Q_1 \times 1 + Q_2 + Q_3 \times 1 = 5.1$ |
| 3 | $Q_2 \times 2 + Q_3 \times 1 = 5.7$ |
| 4 | $Q_1 + Q_2 \times 2 + Q_3 = 6.7$ |

Nine flow rate patterns are obtained, however, some patterns are almost overlapped.

The absolute number=9/6.7=1.37

TABLE 13

Combination 6:
$Q_1 = 1.0 \times 1$ pump, $Q_2 = 1.6 \times 1$ pump,
$Q_3 = 2.5 \times 2$ pumps

| The number of pumps to be in operation | Flow rate |
|---|---|
| 1 | $Q_1 = 1.0$ |
| 1 | $Q_2 = 1.6$ |
| 1 | $Q_3 = 2.5$ |
| 2 | $Q_1 + Q_2 = 2.6$ |
| | $Q_1 + Q_3 = 3.5$ |
| 2 | $Q_2 + Q_3 = 4.1$ |
| 2 | $Q_3 \times 2 = 5.0$ |
| 3 | $Q_1 \times 1 + Q_2 \times 1 + Q_3 \times 1 = 5.1$ |
| 3 | $Q_1 \times 1 + Q_3 \times 2 = 6.0$ |
| 3 | $Q_2 \times 1 + Q_3 \times 2 = 6.6$ |
| 4 | $Q_1 + Q_2 + Q_3 \times 2 = 7.6$ |

Nine flow rate patterns are obtained, however, some patterns are almost overlapped.

The absolute number=9/7.6=1.18

TABLE 14

| Combination 7: $Q_1$ 1.0 × 1 pump, $Q_2$ = 1.6 × 1 pump, $Q_3$ = 2.5 × 1 pump, $Q_4$ = 4.0 × 1 pump (4.0 = 2.5 × 1.6) | |
|---|---|
| The number of pumps to be in operation | Flow rate |
| 1 | $Q_1 = 1.0$ |
| 1 | $Q_2 = 1.6$ |
| 1 | $Q_3 = 2.5$ |
| 1 | $Q_4 = 4.0$ |
| 2 | $Q_1 + Q_2 = 2.6$ |
| 2 | $Q_1 + Q_3 = 3.5$ |
| 2 | $Q_1 + Q_4 = 5.0$ |
| 2 | $Q_2 + Q_3 = 4.1$ |
| 2 | $Q_2 + Q_4 = 5.6$ |
| 2 | $Q_3 + Q_4 = 6.5$ |
| 3 | $Q_1 + Q_2 + Q_3 = 5.1$ |
| 3 | $Q_1 + Q_2 + Q_4 = 6.6$ |
| 3 | $Q_1 + Q_3 + Q_4 = 7.5$ |
| 3 | $Q_2 + Q_3 + Q_4 = 8.1$ |
| 4 | $Q_1 + Q_2 + Q_3 + Q_4 = 9.1$ |

Ten flow rate patterns are obtained, however, some patterns are almost overlapped.

The absolute number=10/9.1=1.10

As is apparent from the above, combination of $Q_1$=1.0×2 pumps and $Q_2$=1.6×2 pumps are most effective because it has the largest absolute number. In other words, the difference between two adjacent flow rate is the smallest of the above combinations, thus the flow rate can be finely controlled.

Figure 13A:
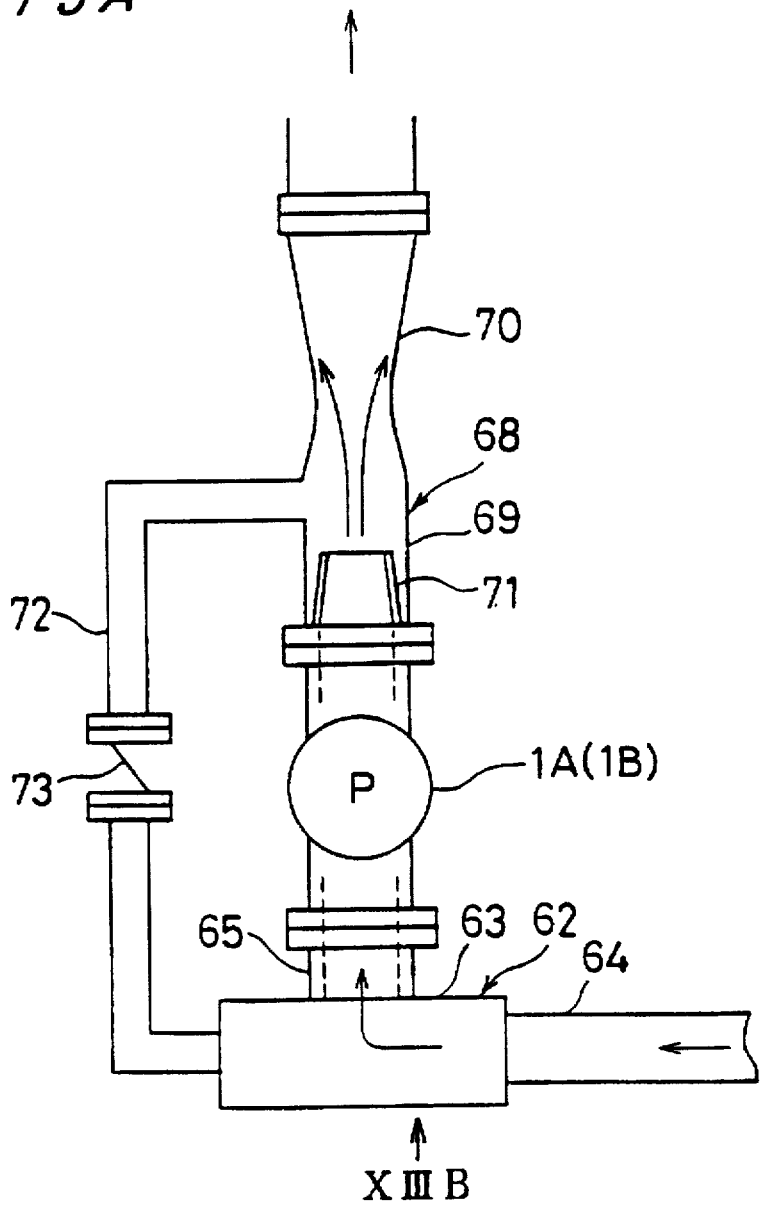
FIG. 13A is a front view in partly section showing a fluid control device according to an embodiment of the present invention.
Figure 13B:
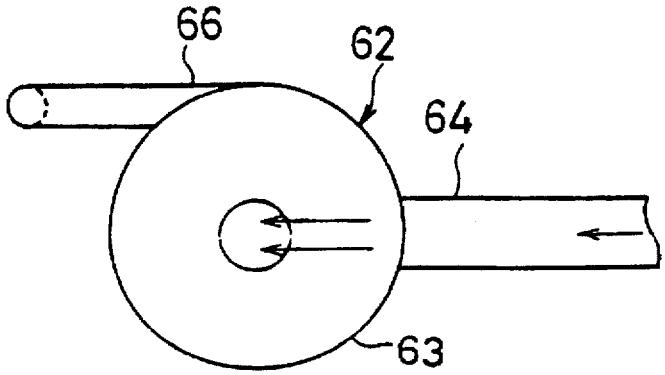
FIG. 13B is a view as viewed from an arrow XIIIB of FIG. 13A.

Next, the fluid control device 62 incorporated in the feed water pump system in FIGS. 11 and 12 will be described below with reference to FIGS. 13(A) and 13(B). As shown in FIG. 13(A), the fluid control device 62 serving as a device for preventing over discharge is provided at the suction side of the pumps 1A and 1B. The negative pressure generating device 68 is provided at the discharge side of the pump 1A or 1B. The fluid control device 62 comprises a cylindrical body 63, a suction port 64, a discharge port 65 and a nozzle 66. The discharge port 65 is connected to the suction port of the pump 1A or 1B.

The negative pressure generating device 68 comprises a cylindrical body 69, a diffuser 70 extending from the cylindrical body 69 upwardly and a nozzle 71 provided in the cylindrical body 69. The cylindrical body 69 is connected to the fluid control device 62 by a bypass pipe 72 with a check valve 73. The nozzle 71 is connected to the discharge port of the pump 1A or 1B.

Next, operation of the fluid control device 62 will be described below.

(1) Normal operation

When the pump is normally operated, the pressure in the negative pressure generating device 68 is higher than that in the fluid control device 62. The fluid flow from the negative pressure generating device 68 to the fluid control device 62 is checked by the check valve 73. As a result, the fluid flow at the suction side of the pump 1A or 1B is not affected by the fluid control device 62 (see FIG. 13(B)).

(2) Over discharge

Figure 14A:
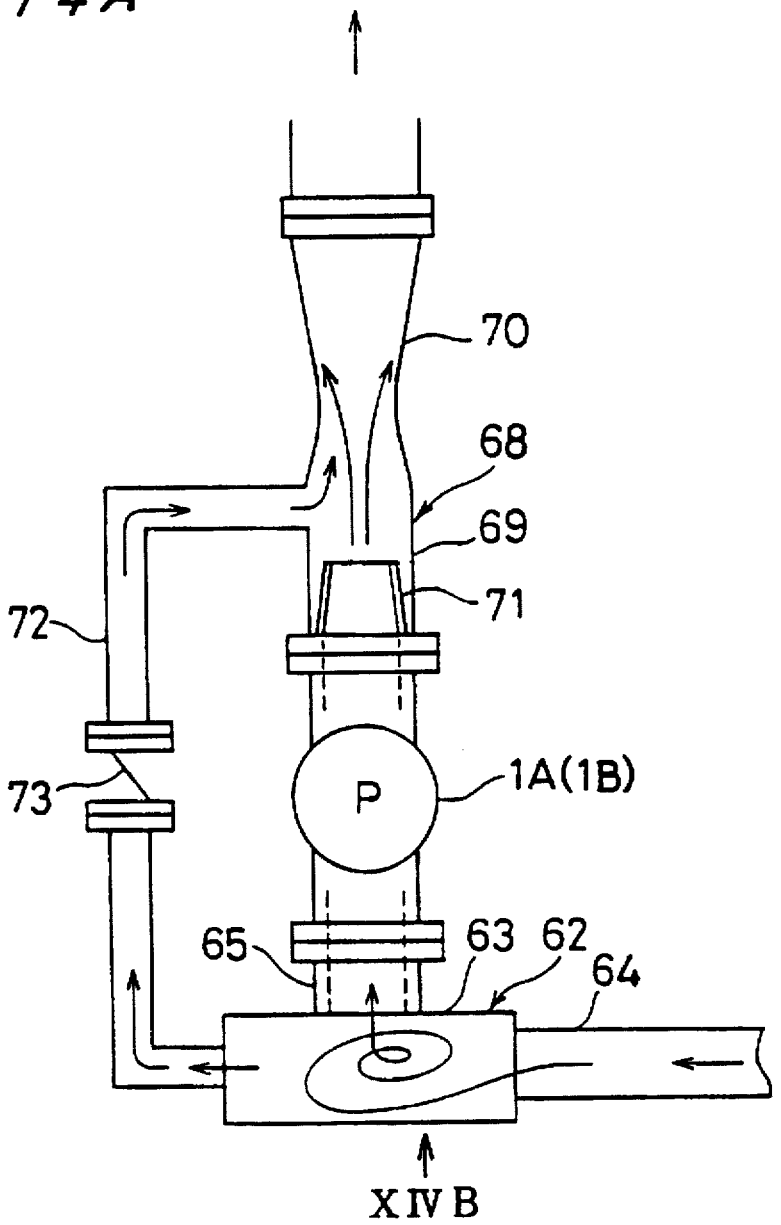
FIG. 14A is a front view in partly section showing a fluid control device according to an embodiment of the present invention.

When the over discharge occurs, the pressure in the negative pressure generating device 68 is lower than that in the fluid control device 62. Therefore, as shown in FIG. 14(A), the fluid flows from the fluid control device 62 to the negative pressure generating device 68 through the pipe 72. This fluid flow speeds up as the flow rate of the pump 1A or 1B increases.

Figure 14B:
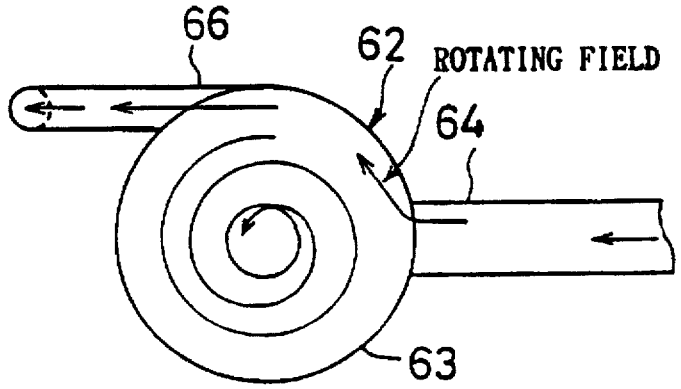
FIG. 14B is a view as viewed from an arrow XIVB of FIG. 14A.

On the other hand, the fluid flow control device 62 has the rotating field generating nozzle 66, therefore the rotating field is formed by the fluid flow from the fluid control device 62 to the negative pressure generating device 68 (see FIG. 14(B)). Consequently, the fluid flow at the suction side of the pump 1A or 1B is suppressed, thus the flow rate of the pump 1A or 1B decreases. When the flow rate of the pump decreases, the rotating field in the fluid control device 62 becomes weak. Therefore, suppression effect of fluid flow at the suction side of the pump 1A or 1B becomes weak, the flow rate of the pump 1A or 1B increases. In this manner, the pump 1A or 1B can be stably in operation at a certain flow rate.

Figure 15:
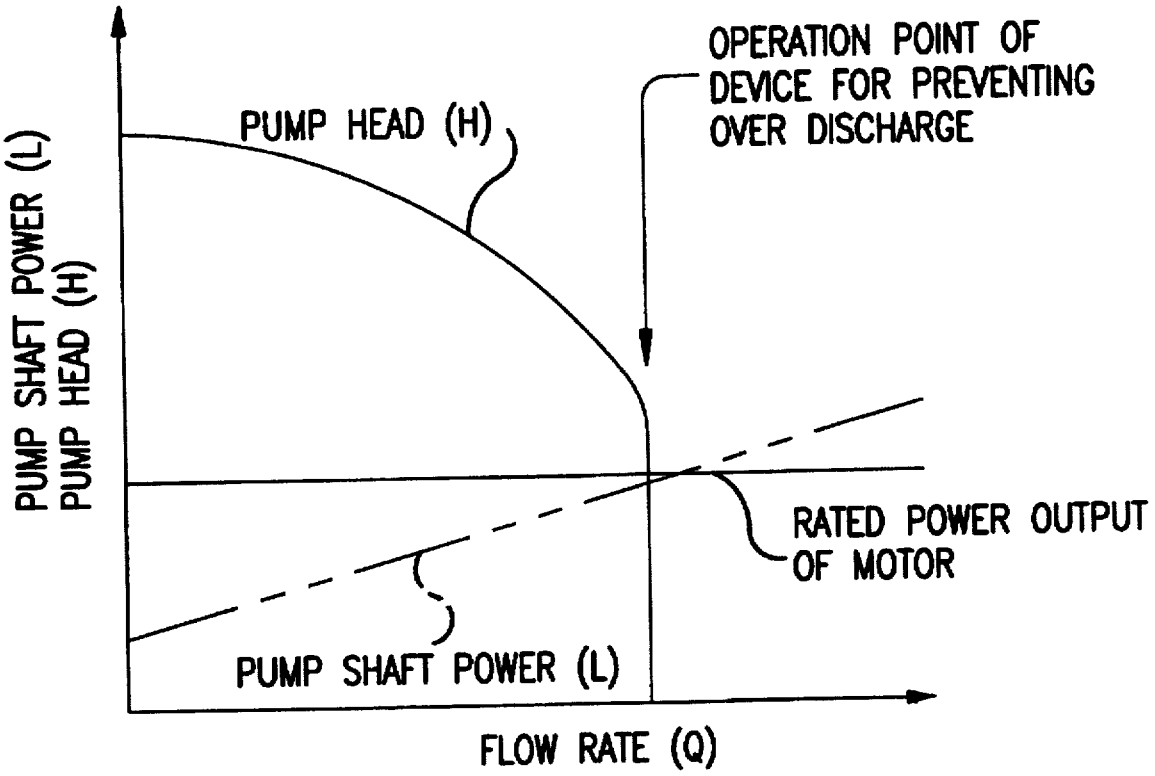
FIG. 15 is a diagram showing the relationship between flow rates (Q) and pump head (H), shaft power (L).

FIG. 15 shows an effect of the device for preventing over discharge. The horizontal axis indicates flow rate (Q), and the vertical axis indicates head (H) and shaft power (L). As shown in FIG. 15, when the flow rate discharged from the pump 1A or 1B becomes excessive, the negative pressure generating device 68 is actuated and the rotating field is formed in the fluid control device 62. That is, the flow rate becomes constant at the operating point of the device for preventing over discharge. In the case where the negative pressure generating device 68 is provided on the pipe having the pump 1A as shown in FIG. 12, the whole feed water pump system becomes compact in size. Further, since the negative pressure generating device 68 generates loss of head, it is better to install it at immediately upstream side of the pump having a small power than at the discharge header.

According to the present invention, since many kinds of flow rate patterns can be obtained, the pumps can be efficiently operated in accordance with the required water consumption, and running cost can be reduced. Further, when switching operation pattern of the pump, transit patterns are provided to avoid instantaneous pressure decrease.

Although certain preferred embodiments of the present invention has been shown and described in detail, it should be understood that various changes and modifications may be made therein without departing from the scope of the appended claims.

What is claimed is:

1. A family of pumps of different pump heads and different nominal ratios of flow rates at the same speed, comprising:

a plurality of pump casings;

a plurality of motors; and a plurality of impellers of different outer diameters, said plurality of impellers being mounted to output shafts of said plurality of motors and being positioned in said plurality of pump casings to produce said family of pumps in which at least one of said impellers is mounted to the output shaft of each of said motors of said family of pumps, wherein a nominal ratio K of the flow rates of said pumps of said family of pumps at substantially the same rotational speed is about 1.6 and the nominal ratio of the pump heads thereof is about $K^{1/2}$.

* * * * *